US006186414B1

(12) United States Patent
Clearman et al.

(10) Patent No.: US 6,186,414 B1
(45) Date of Patent: Feb. 13, 2001

(54) FLUID DELIVERY FROM A SPRAY HEAD HAVING A MOVING NOZZLE

(75) Inventors: Joseph H. Clearman, Port Gamble, WA (US); Jack F. Clearman, Blakely, GA (US)

(73) Assignee: Moen Incorporated, North Olmsted, OH (US)

( * ) Notice: Under 35 U.S.C. 154(b), the term of this patent shall be extended for 0 days.

(21) Appl. No.: 09/150,480

(22) Filed: Sep. 9, 1998

(51) Int. Cl.[7] ..... B05B 3/02

(52) U.S. Cl. ..... 239/214; 239/219; 239/237; 239/240; 239/242; 239/380; 239/381; 239/382; 239/383

(58) Field of Search ..... 239/214, 219, 239/237, 240, 242, 380, 381, 382, 383

(56) References Cited

U.S. PATENT DOCUMENTS

| | | |
|---|---|---|
| 2,151,214 | 3/1939 | Kramer . |
| 2,186,786 | 1/1940 | Jensen . |
| 2,622,927 | 12/1952 | Sarbu . |
| 2,639,191 | 5/1953 | Hruby, Jr. . |
| 2,831,333 | 4/1958 | Smith . |
| 2,848,276 | 8/1958 | Clearman . |
| 2,902,851 | 9/1959 | Fields . |
| 2,931,201 | 4/1960 | Hubbard . |
| 2,954,171 | 9/1960 | Hruby, Jr. . |
| 2,967,024 | 1/1961 | Aubert . |
| 2,974,877 | 3/1961 | Hruby, Jr. . |
| 3,000,575 | 9/1961 | Hruby, Jr. . |
| 3,009,648 | 11/1961 | Hait . |
| 3,034,728 | 5/1962 | Hruby, Jr. . |
| 3,091,400 | 5/1963 | Aubert . |
| 3,126,025 | 3/1964 | Aubert et al. . |
| 3,357,643 | 12/1967 | Hruby, Jr. . |
| 3,447,749 | 6/1969 | Hruby, Jr. . |
| 3,734,410 | 5/1973 | Bruno . |
| 3,791,584 | 2/1974 | Drew . |
| 3,826,429 | 7/1974 | Moen . |
| 3,880,357 | 4/1975 | Baisch . |
| 3,929,287 | 12/1975 | Givler . |
| 4,018,385 | 4/1977 | Bruno . |

(List continued on next page.)

FOREIGN PATENT DOCUMENTS

| | | |
|---|---|---|
| 42 21 587 A1 | 1/1994 | (DE) . |
| 42 24 664 A1 | 1/1994 | (DE) . |
| 0676241 | 12/1995 | (EP) . |
| 0836888 | 4/1998 | (EP) . |
| 0841096 | 5/1998 | (EP) . |
| 03231620 | 10/1991 | (JP) . |

OTHER PUBLICATIONS

Michael D. Handler, PCT Publication, May 13, 1993, 2 pages.

* cited by examiner

*Primary Examiner*—Kevin Shaver
*Assistant Examiner*—David Deal
(74) *Attorney, Agent, or Firm*—Cook, Alex, McFarron, Manzo, Cummings & Mehler, Ltd.

(57) ABSTRACT

The present invention provides a spray head assembly with a moving spray nozzle that delivers fluid in a substantially uniform spray distribution. The movement of the spray nozzle is a wobbling motion, preferably combined with some rotational motion. The wobbling motion is generated by disposing a wobble inducing member or wobble turbine in the path of the fluid supply. The water flowing over the wobble turbine causes the turbine to wobble. The wobbling turbine then causes the spray housing and nozzle to wobble. The spray pattern produced by the wobbling spray housing changes more or less rapidly so that fluid droplets or streams are directed along arcuate paths rather than at a single point. This type of spray distribution pattern is gentler than many stationary patterns and the unique design of the wobble inducing member does not include complex mechanical parts or significant flow restrictions.

18 Claims, 30 Drawing Sheets

U.S. PATENT DOCUMENTS

| | | | | |
|---|---|---|---|---|
| 4,026,470 | | 5/1977 | Crist . | |
| 4,068,801 | * | 1/1978 | Leutheuser | 239/383 X |
| 4,073,438 | | 2/1978 | Meyer . | |
| 4,117,979 | | 10/1978 | Lagarelli . | |
| 4,457,343 | | 7/1984 | Zukansky . | |
| 4,478,367 | | 10/1984 | Petursson . | |
| 4,487,368 | * | 12/1984 | Clearman | 239/237 X |
| 4,508,144 | | 4/1985 | Bernett . | |
| 4,542,853 | | 9/1985 | Diamond . | |
| 4,629,404 | | 12/1986 | Raymond . | |
| 4,754,925 | | 7/1988 | Rubinstein . | |
| 4,801,091 | | 1/1989 | Sandvik . | |
| 4,802,628 | | 2/1989 | Dautel et al. . | |
| 4,828,179 | | 5/1989 | Garner . | |
| 4,838,486 | | 6/1989 | Finkbeiner . | |
| 4,933,999 | | 6/1990 | Mikiya et al. . | |
| 4,944,457 | | 7/1990 | Brewer . | |
| 4,951,877 | | 8/1990 | Arsi . | |
| 4,989,786 | | 2/1991 | Kranzle et al. . | |
| 5,058,220 | | 10/1991 | Mikiya . | |
| 5,108,035 | | 4/1992 | Friedrichs . | |
| 5,163,615 | | 11/1992 | Bauer . | |
| 5,201,468 | | 4/1993 | Freier et al. . | |
| 5,217,166 | | 6/1993 | Schulze et al. . | |
| 5,248,092 | | 9/1993 | Rankin . | |
| 5,294,054 | | 3/1994 | Benedict et al. . | |
| 5,316,216 | | 5/1994 | Cammack et al. . | |
| 5,328,097 | | 7/1994 | Wesch et al. . | |
| 5,332,155 | | 7/1994 | Jager . | |
| 5,381,960 | | 1/1995 | Sullivan et al. . | |
| 5,395,053 | | 3/1995 | Frech . | |
| 5,439,174 | | 8/1995 | Sweet . | |
| 5,467,927 | | 11/1995 | Lee . | |
| 5,504,955 | | 4/1996 | Mueller et al. . | |
| 5,507,053 | | 4/1996 | Mueller et al. . | |
| 5,518,181 | | 5/1996 | Shames et al. . | |
| 5,551,635 | | 9/1996 | Jager . | |
| 5,577,664 | | 11/1996 | Heitzman . | |
| 5,588,595 | | 12/1996 | Sweet . | |
| 5,598,975 | | 2/1997 | Jager . | |
| 5,671,885 | | 9/1997 | Davisson . | |
| 5,697,392 | | 12/1997 | Johnson et al. . | |
| 5,704,547 | | 1/1998 | Golan . | |
| 5,722,592 | | 3/1998 | Jager . | |
| 5,810,257 | | 9/1998 | Ton . | |
| 5,918,811 | | 7/1999 | Denham et al. . | |
| 5,950,927 | * | 9/1999 | Elliott et al. | 239/383 X |

CLEARMAN

CLEARMAN

FIG. 11A
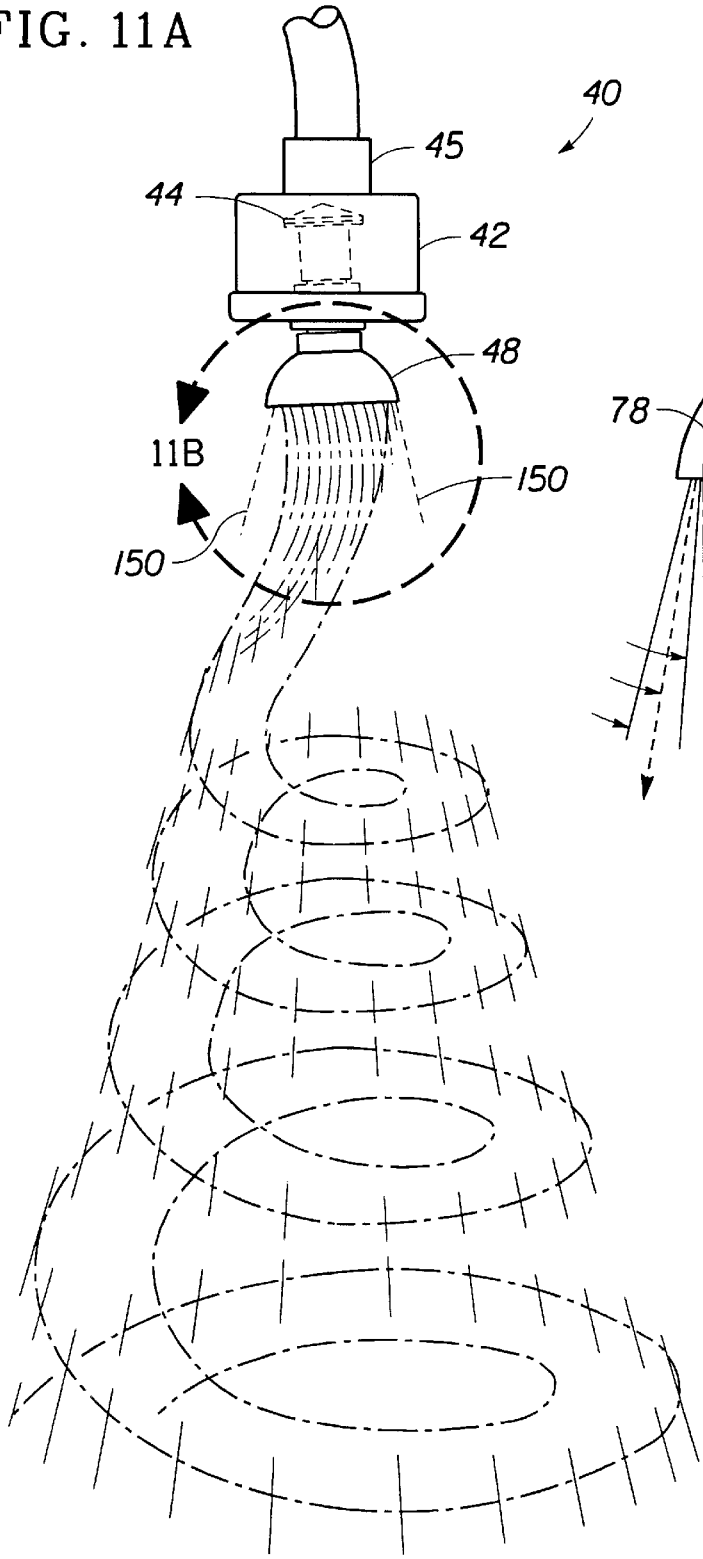
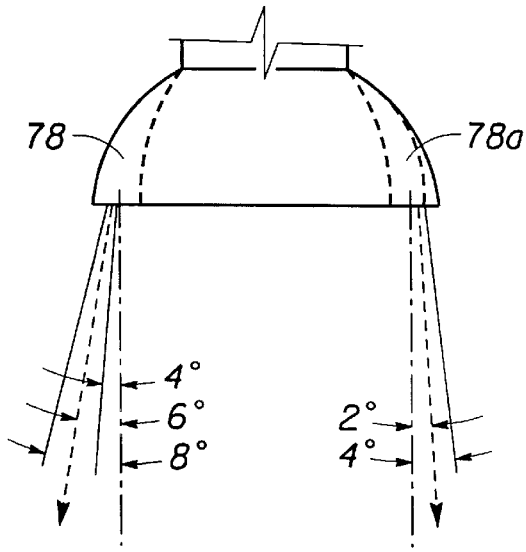
FIG. 11B

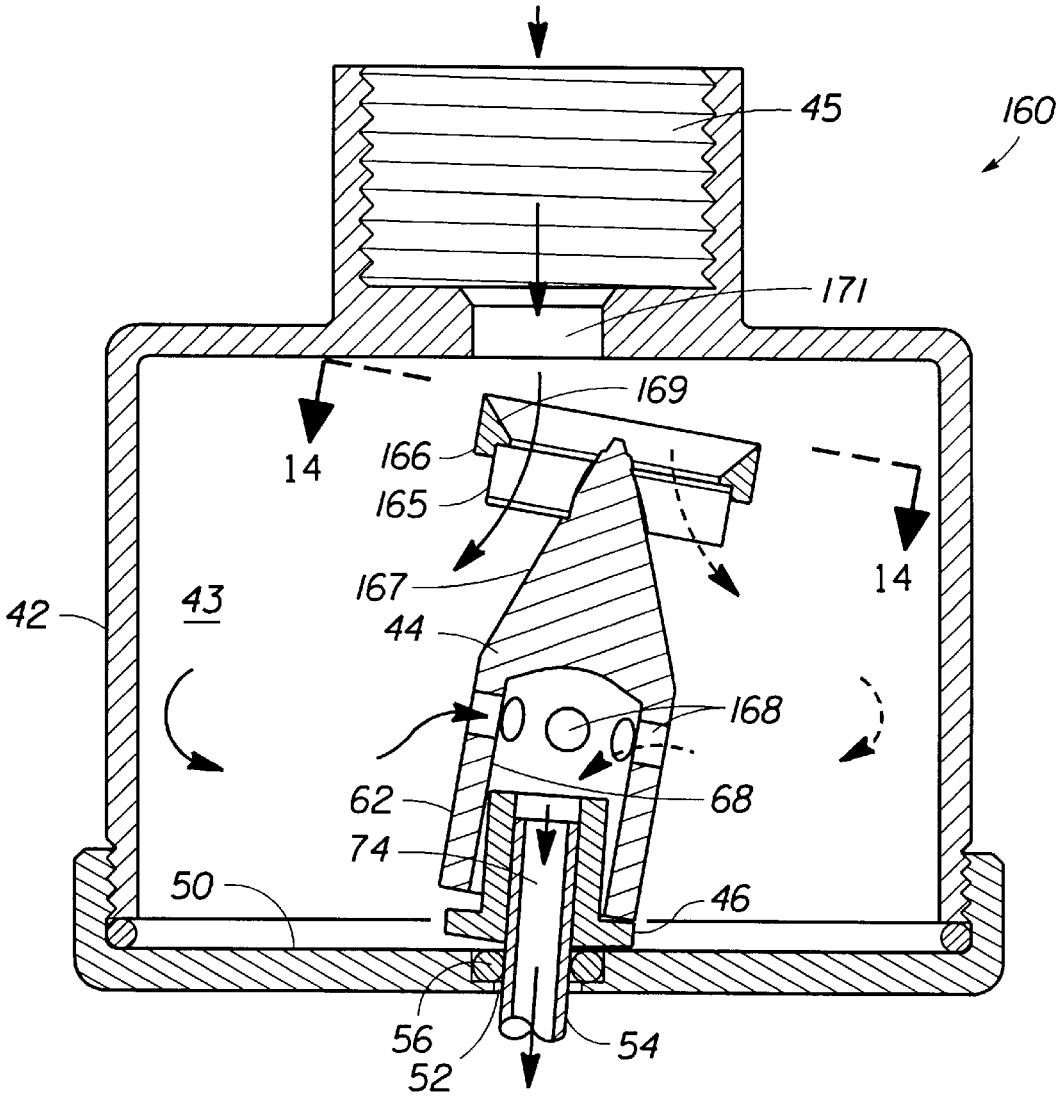
FIG. 13
FIG. 14
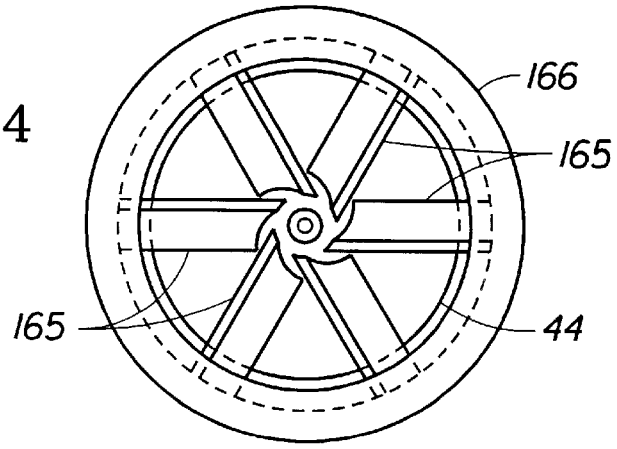

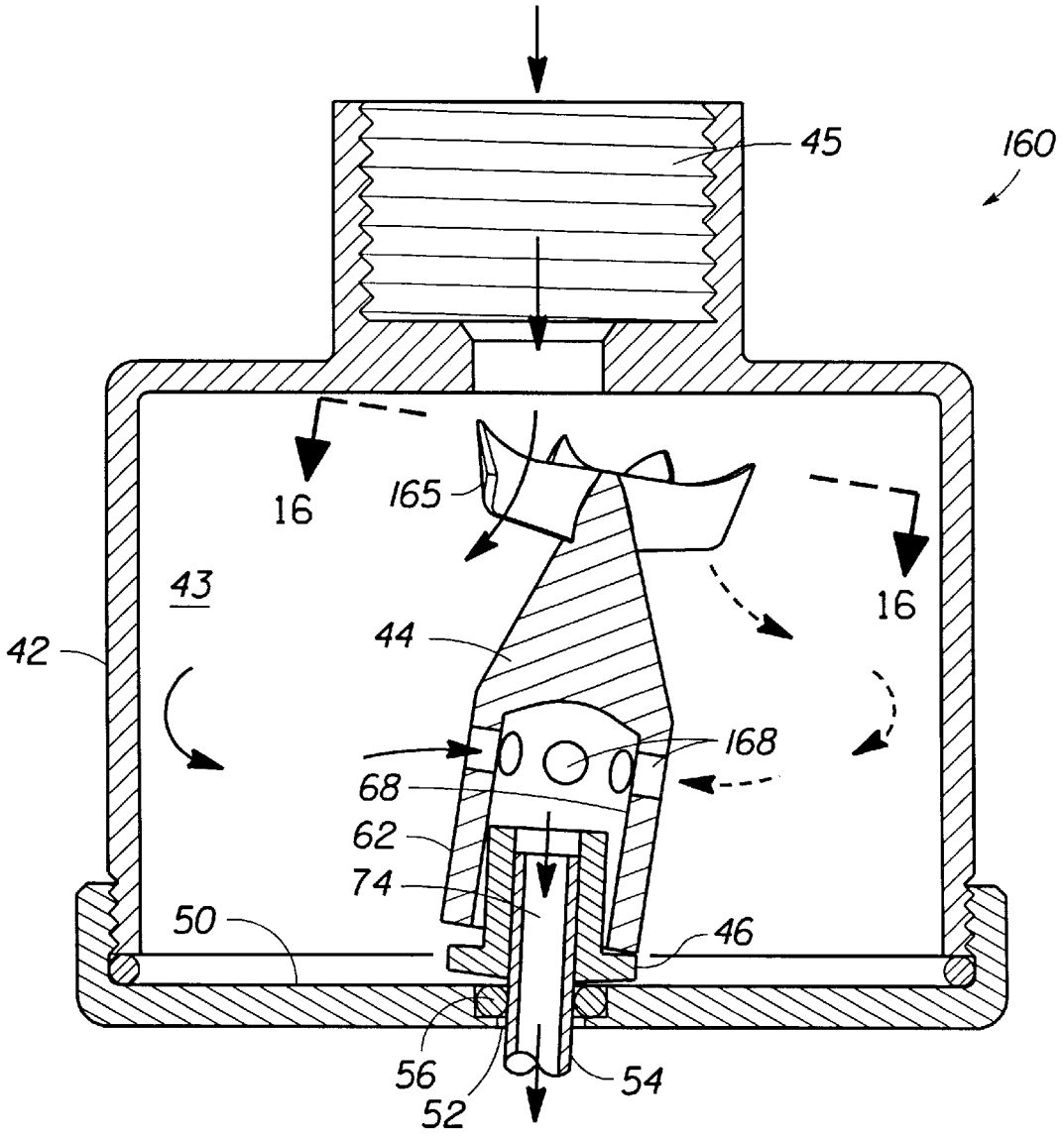
FIG. 15
FIG. 16
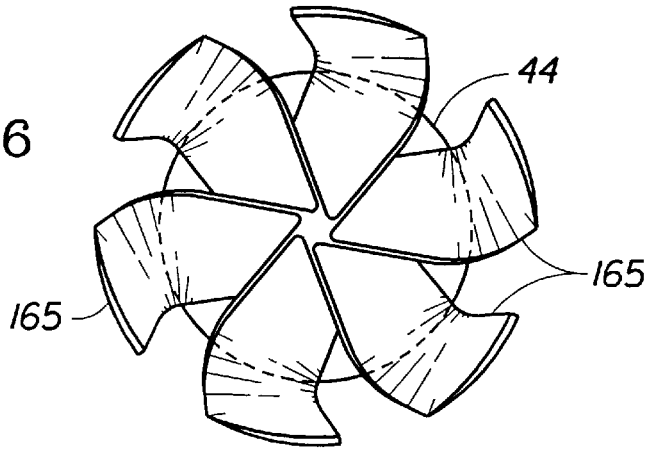

FLUID DELIVERY FROM A SPRAY HEAD HAVING A MOVING NOZZLE

BACKGROUND OF THE INVENTION

1. Field of the Invention

This invention relates to methods and apparatus for controlling fluid delivery from a spray head having a moving spray nozzle.

2. Background of the Related Art

Showerheads are commercially available in numerous designs and configurations. While many showerheads are designed and sold for their decorative styling, there is a great number of different showerhead mechanisms which are intended to improve or change one or more characteristic of the water spray pattern. Any particular spray pattern may be described by the characteristics of spray width, spray distribution or trajectory, spray velocity, and the like. Furthermore, the spray pattern may be adapted or designed for various purposes, including a more pleasant feeling to the skin, better performance at rinsing, massaging of muscles and conservation of water, just to name a few.

The vast majority of showerheads may be categorized as being either stationary or oscillating and having either fixed or adjustable openings or jets. Stationary showerheads with fixed jets are the simplest of all showerheads, consisting essentially of a water chamber and one or more jets directed to produce a constant pattern. Stationary showerheads with adjustable jets are typically of a similar construction, except that some may allow adjustment of the jet direction, jet opening size and/or the number of jets utilized. For example, a showerhead currently used in typical new residential home construction provides a stationary spray housing having a plurality of spray jets disposed in a circular pattern, wherein the velocity of the spray is adjustable my manually rotating an adjustment ring relative to the spray housing.

These stationary showerheads cause water to flow through its apertures and contact essentially the same points on a user's body in a repetitive fashion. Therefore, the user feels a stream of water continuously on the same area and, particularly at high pressures or flow rates, the user may sense that the water is drilling into the body, thus diminishing the positive effect derived from such a shower head. In order to reduce this undesirable feeling, various attempts have been made to provide oscillating showerheads.

Examples of oscillating showerheads are disclosed in U.S. Pat. Nos. 3,791,584 (Drew et al.), 3,880,357 (Baisch), 4,018,385 (Bruno), 4,944,457 (Brewer), and 5,577,664 (Heitzman). U.S. Pat. No. 4,944,457 (Brewer) discloses an oscillating showerhead that uses an impeller wheel mounted to a gear box assembly which produces an oscillating movement of the nozzle. Similarly, U.S. Pat. No. 5,577,664 (Heitzman) discloses a showerhead having a rotary valve member driven by a turbine wheel and gear reducer for cycling the flow rate through the housing between high and low flow rates. Both of these showerheads require extremely complex mechanical structures in order to accomplish the desired motion. Consequently, these mechanism are prone to failure due to wear on various parts and mineral deposits throughout the structure.

A particularly useful action for a showerhead is referred to as "wobbling." The term "wobbling" may be defined as the motion of a circular member rolling on its edge along a surface following a circular path. A common example of wobbling is what occurs when a coin is spun on its edge over a smooth surface. The coin begins spinning or rotating in an vertically upright position, but as the coin slows, the coin begins to wobble along a circular path having an ever increasing diameter until the coin comes to rest on its face. While a wobbling motion will often be accompanied by some degree of rotation, a wobbling member will have points on its surface which experience a sequence of up and down motions as well.

Most spray heads, whether they are stationary or oscillating, deliver fluids in a predetermined manner. The user is not allowed to effect changes in the fluid delivery characteristics of the spray head, except perhaps increasing or decreasing the fluid flow rate by turning the control valve that communicates fluid to the spray head. One such spray head which actually allows user adjustments between a vibrating mode and a non-vibrating mode is disclosed in U.S. Pat. No. 5,467,927 (Lee). However, spray heads that allow adjustment of other fluid delivery characteristics have not been available.

Therefore, there is a need for an improved spray head or showerhead that allows a user to adjust or control the delivery of fluid. Characteristics of the fluid delivery that would be particularly desirable include the spray width, the spray velocity and spray flow rate. It would be desirable if the spray head were able to deliver water in the desired manner, even at low pressures or flow rates dictated or desirable for water conservation. It would be further desirable if the spray head provided a simple design and construction with minimal restriction to water flow.

SUMMARY OF THE INVENTION

The present invention provides a method and apparatus for altering the fluid delivery characteristics of a spray head having a moving spray nozzle, preferably a wobbling spray nozzle. A user can alter the fluid delivery characteristics of the spray nozzle by manipulating various simple interfaces, including push buttons, knobs with cams attached thereto, and other simple devices for manipulating or limiting the movement of the spray nozzle. More particularly, as described previously, the present invention delivers fluid through a nozzle assembly that is coupled to, integrally formed with, or at least in a cooperative relationship with, a motion inducing member. Therefore, altering or controlling the movement of the motion inducing member or the movement of the nozzle assembly itself can be made to alter or control the delivery of fluid from the nozzle assembly. The present invention alters or controls movement of the nozzle assembly by either (a) changing the forces acting upon the motion inducing member (i.e., increasing, decreasing, redirecting the flow of fluid relative to the motion inducing member), (b) limiting the range of motion that the motion inducing member can traverse (i.e., constraining or loosening the physical boundaries of the motion inducing member, either directly or indirectly), (c) limiting the range of motion that the nozzle assembly can traverse, or (d) some combination of (a) through (c).

BRIEF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are, therefore, not to be considered limiting of its scope, because the invention may admit to other equally effective embodiments.

FIGS. 11A–B are schematic side views of a spray head and the pattern/angles of water delivered by the spray head.

FIG. 13 is a cross-sectional side view of a fifth embodiment of the shower head assembly of the present invention having a tracking ring.

FIG. 14 is a top view taken along lines 14—14 of the embodiment shown in FIG. 13.

FIG. 15 is a cross-sectional side view of a sixth embodiment of the shower head assembly of the present invention.

FIG. 16 is a top view taken along lines 15—15 of the embodiment shown in FIG. 15.

DETAILED DESCRIPTION OF THE INVENTION

Figure 1:
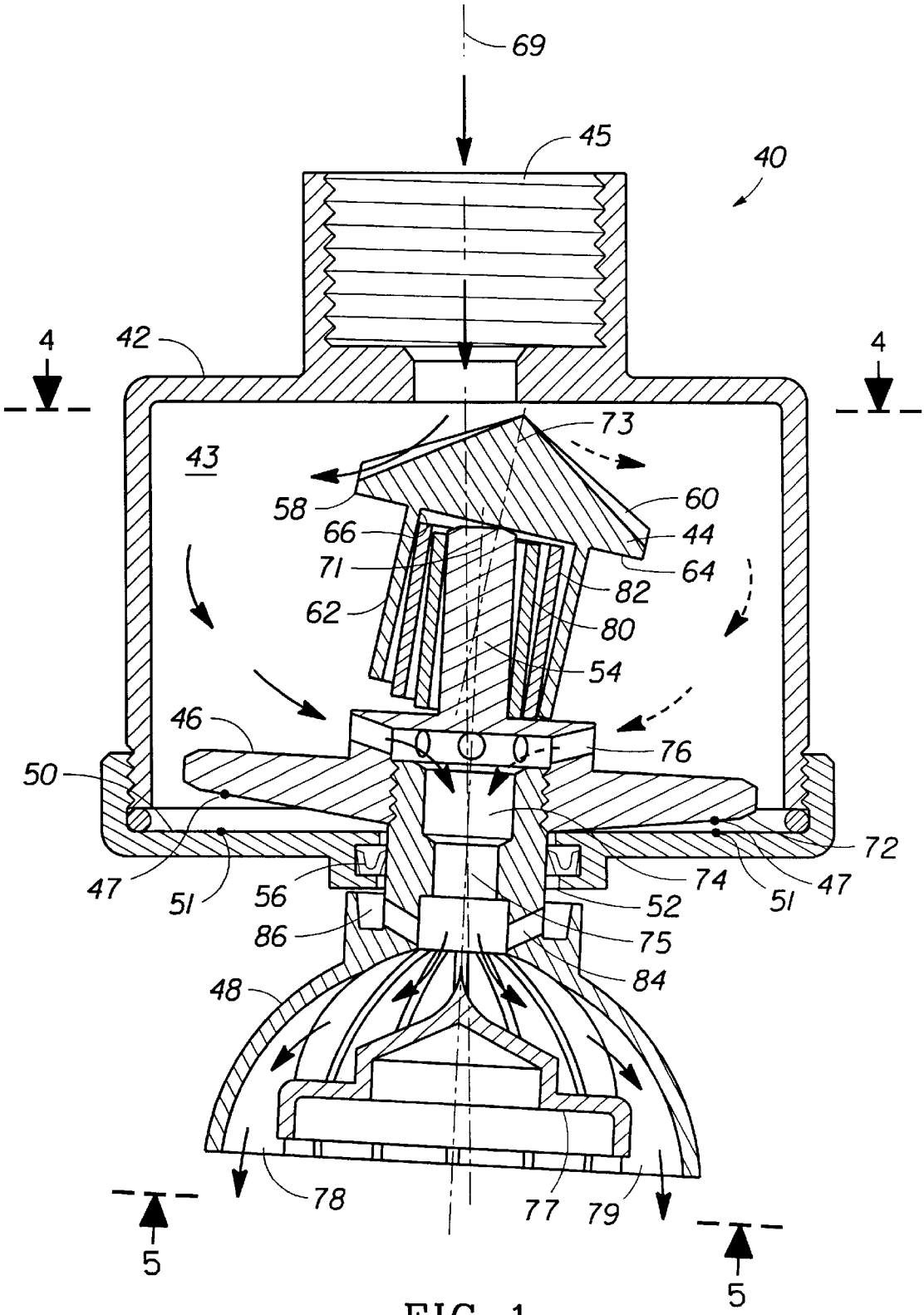
FIG. 1 is a cross-sectional side view of a first embodiment of a spray head assembly of the present invention.

The present invention provides a spray head assembly that allows the user to adjust or control at least one characteristic of the fluid delivered from the spray head, such as the spray width, the spray velocity or impact, the volumetric flow rate, and the droplet size. The spray head assembly includes a housing, a nozzle assembly, a motion inducing member and a motion limiting member. The types of motions useful in accordance with the invention include wobbling, vibrating, spinning and the like. The most preferred motion is wobbling.

The present invention delivers fluid through a nozzle assembly that is coupled to, or at least in a cooperative relationship with, a motion inducing member. Therefore, altering or controlling the movement of the motion inducing member or the movement of the nozzle assembly itself can be made to alter or control the delivery of fluid from the nozzle assembly. The present invention alters or controls movement of the nozzle assembly by either (a) changing the forces acting upon the motion inducing member (i.e., increasing, decreasing, redirecting the flow of fluid relative to the motion inducing member), (b) limiting the range of motion that the motion inducing member can traverse (i.e., constraining or loosening the physical boundaries of the motion inducing member, either directly or indirectly), (c) limiting the range of motion that the nozzle assembly can traverse, or (d) some combination of (a) through (b).

The housing has a first end having a fluid inlet and a second end forming a collar or opening therein. The nozzle assembly has a first end disposed inside the housing, a middle portion extending through the opening, a second end having an fluid outlet, a fluid conduit providing fluid communication between the housing and the fluid outlet. The nozzle assembly is caused to wobble by fluid flowing past, over or through the wobble inducing member.

The most preferred spray head for use in conjunction with the present invention is the wobbling spray head described below with reference to FIGS. 1–19, which subject matter was disclosed by the present inventors in their copending U.S. patent application Ser. No. 09/115,362, filed on Jul. 14, 1998, which application is incorporated by reference herein. Accordingly, the wobble limiting member preferably comprises a wobble plate, most preferably a wobble plate having a convex frustoconical surface that engages the housing adjacent the opening to limit movement of the nozzle assembly. Furthermore, the wobble inducing member is preferably a wobble turbine, most preferably having a convex conical upper surface with angular momentum inducing grooves, preferably non-radial groove, formed therein.

However, spray heads having other motion inducing members, including other wobble inducing members, may also be used in conjunction with various asepcts of the present invention. For example, U.S. Pat. No. 3,691,584 (Drew et al.), which is incorporated herein by reference, discloses an oscillating showerhead that utilizes a nozzle mounted on a stem that rotates and pivots under forces places on it by water entering through radially disposed slots into a chamber around the stem.

U.S. Pat. No. 5,467,927 (Lee), which is incorporated herein by reference, discloses a showerhead with a turbine having a plurality of blades designed to produce vibration and pulsation. One blade is provided with an eccentric weight which causes vibration and an opposite blade is provided with a front flange which cause pulsation by momentarily blocking the water jets.

U.S. Pat. No. 5,704,547 (Golan et al.), which is incorporated herein by reference, discloses a shower head including a housing, a turbine and a fluid exit body, such that fluid flowing through the turbine causes rotation of the turbine. The rotating (spinning) turbine can be used to cause rotation of the fluid exit body and/or a side-to-side rocking motion in a pendulum like manner.

U.S. Pat. No. 4,073,438 (Meyer), which is incorporated herein by reference, discloses a sprinkler head having a housing with an inlet, a water distributing structure having a nozzle on one end and a cup shaped element at the opposite end which is operative in response to the tangential flow of water into the housing for effecting the orbital movement of the nozzle. There is also disclosed a disk that rotates in rolling contact with a surface within the housing for effecting the fractional rotation of the nozzle. The cup shaped element rotates about the longitudinal axis in response to the flow of water from the inlet.

Description of the Preferred Spray Head Assembly

The present invention provides a spray head assembly with a moving spray nozzle that delivers fluid in a substantially uniform spray distribution. The movement of the spray nozzle is a wobbling motion, preferably combined with some rotational motion. The wobbling motion is generated by disposing a wobble inducing member or wobble turbine in the path of the fluid supply inside a housing. The water flowing over the wobble turbine causes the wobble turbine to wobble. The wobbling turbine then causes the spray nozzle to wobble. The spray pattern produced by the wobbling spray nozzle changes more or less rapidly so that fluid droplets or streams are directed along arcuate paths over time rather than continuously at a single point. This type of spray distribution pattern is gentler than many stationary patterns and the unique design of the wobble turbine does not include complex mechanical parts or significant flow restrictions.

More particularly, the present invention provides for a spray head assembly having a housing, a nozzle assembly, a wobble inducing member and a wobble limiting member. The housing has a first end having a fluid inlet and a second end forming a collar or opening therein. The nozzle assembly has a first end forming a post disposed inside the housing, a middle portion extending through the opening, a second end having an fluid outlet, a fluid conduit providing fluid communication between the housing and the fluid outlet, and the wobble limiting member. The nozzle assembly is positioned downstream of the fluid inlet. The wobble inducing member is disposed in the fluid channel facing the fluid inlet and has a sleeve extending therefrom to loosely receive the post therein. The nozzle assembly is caused to wobble by fluid flowing past, over or through the wobble inducing member.

The post comprises at least one inlet, preferably a plurality of radial channels, and a passage providing fluid communication between the post inlet and the fluid outlet. The inlet can be tangential to the centerline of the passage. The post and sleeve may be conical.

Preferably, the fluid outlet comprises a spray nozzle and a plurality of outlet channels formed in the spray nozzle. A sealing element may be disposed between the collar and the middle portion of the nozzle assembly to prevent leakage of fluid out of the housing via the collar.

In another embodiment, the present invention provides a spray head assembly having a housing, a nozzle having a wobble limiting member and a wobble inducing member. The housing has a first end having a fluid inlet and a second end forming a opening. The nozzle assembly has a first end forming a sleeve disposed inside the housing, a middle portion extending through the opening, a second end having an fluid outlet, a fluid conduit in fluid communication between the housing and the fluid outlet. The first end of the nozzle assembly is positioned downstream of the fluid inlet. The wobble inducing member is disposed in the housing facing the fluid inlet and having a post extending therefrom loose engagement with the sleeve, preferably, the post and sleeve are conical.

In another embodiment, there is provided, a spray head assembly having a housing, a nozzle having a wobble limiting member and a wobble inducing member. The housing has a first end having a fluid inlet end, a second end having an opening and a flow channel extending between the first and second ends. The nozzle assembly has a first end disposed inside the housing, the wobble inducing member coupled to the first end, a middle portion extending through the opening, the wobble limiting member coupled to the middle portion adjacent the opening, a second end having an outlet nozzle, and a water channel providing fluid communication between the flow channel and the outlet nozzle.

Preferably, the wobble inducing member is a wobble turbine head and the wobble turbine head forms a conical surface with partially tangential grooves facing the fluid inlet end of the housing. The wobble limiting member can be a wobble plate.

In a preferred embodiment, the wobble inducing member may be a wobble turbine head having a plurality of radially extending vanes positioned downstream of the fluid inlet of the housing. The wobble limiting member can be a ring attached to the vanes.

One aspect of the present invention provides a spray head assembly with a wobble inducing member or wobble turbine that causes a spray nozzle to wobble regardless of the quantity, design or configuration of the spray nozzle outlet channels. More particularly, the wobble inducing member does not rely on tangential outlet channels in the spray nozzle. This allows the outlets of the spray nozzle to be designed in a manner that produces a desired spray width and pattern, such as for a residential shower.

Another aspect of the invention provides a spray nozzle that may include any number and configuration of outlet channels, but preferably has a reduced number of outlet channels having greater internal dimensions to prevent plugging due to mineral deposits or an accumulation of particles. Because the spray nozzle is wobbling, the distribution or coverage of fluid over a surface is extremely uniforml Therefore, fewer outlet channels are necessary to provide full coverage over a surface and, in the case of a shower, achieve a gentle feeling. Since fewer channels are needed, each channel may be widened so that the channels are less likely to become restricted or plug with lime, other minerals or particles. Most preferably, the channels are wide enough to pass ordinary sand introduced into the fluid supply.

Furthermore, the invention provides a velocity system where a major portion of the pressure drop, and preferably substantially all of the pressure drop, through the spray head occurs at one large orifice creating a water jet that is guided and distributed down open channels. This velocity system is advantageous for reducing mineral buildup and the weight of the spray head and spray nozzle. There is less mineral buildup using a velocity system because the outlet channels are no longer dependent upon openings having small cross-sectional areas to divide the water flow into individual streams and, therefore, the outlet channels can be widened or redesigned. The spray head and spray nozzle weigh less with a velocity system because the spray nozzle is downstream of the flow restricting orifice and, therefore, is not full of liquid during operation. Rather, the spray nozzle includes a housing and a diverter within the housing to direct the water exiting the orifice. The reduced weight is particularly beneficial in a wobbling spray nozzle since the reduced mass causes a proportional reduction in the angular momentum of the spray nozzle that causes vibration of the spray head housing. While the velocity system, as just described and as supported by the Figures below, is preferably using in combination with the wobble inducing members described herein, the velocity system may also be used in conjunction with other wobbling mechanisms, including that of U.S. Pat. No. 5,551,635, which patent is incorporated herein by reference, and that of U.S. Pat. No. 4,073,438, which patent is also incorporated herein by reference.

Yet another aspect of the invention provides a wobble limiting member. The spray width of a spray nozzle of the present invention is determined by both the design of the outlet channels in the spray nozzle and the angle of deflection imparted on the spray nozzle. For example, if the spray nozzle provided a 6° spray width during use in a stationary mode and the wobble produced an angular deflection of 5° off center, then the effective spray width during use in a wobbling mode in accordance with the present invention would be about 16° (5° additional width in all directions). Therefore, the wobble limiting member plays an important role in determing the effective spray width of the spray nozzle as well as the extent of the arcuate path that each fluid stream traverses during a single wobble.

A further aspect of the invention is a wobble inducing member that is disposed in direct engagement or contact with the spray head assembly. While the wobble inducing member may be coupled, held or otherwise secured to a spray nozzle assembly, it is generally preferred not to integrate or affix the wobble inducing member to the spray nozzle assembly. More particularly, the spray nozzle assembly has an end that is distal to the spray nozzle. It is preferred that this distal end of the spray nozzle assembly and the wobble inducing member receive each other in a loose male-female relationship, particularly where the distal end and the member can easily slide or pivot into the appropriate relationship without restriction. One particularly preferred arrangement is a cylindrical post (male) received within a cylindrical sleeve (female), where the outer diameter of the post is less than the inner diameter of the sleeve. Alternatively, the post may form a frustoconical surface (male) received within a frustoconical sleeve (female), where the frustoconical angle of the post is less than the frustoconical angle of the sleeve. It should be recognized that the post may be part of the spray nozzle assembly and the sleeve may be part of the wobble inducing member, or vice versa. It is preferred to design the post and sleeve with sufficient tolerances therebetween so that the wobble inducing member can wobble in relation to the spray nozzle assembly without binding. Furthermore, it is most preferred to utilize a wobble inducing member having a conical or frustoconical post of a first diameter received in a conical or frustoconical sleeve of the spray nozzle assembly.

One advantage of the loose fitting relationship of the wobble inducing member or wobble turbine to the spray nozzle assembly is that there is very little friction to be overcome before the wobble turbine will begin wobbling. In this manner, the initiation and maintenance of a wobbling motion of the spray nozzle of the present invention is substantially independent of fluid flow rate and operates very effectively in shower heads even at flow rates much lower than the 2.5 gallons per minute maximum imposed by the laws of many states.

A second advantage of the loose fitting relationship is that the wobble turbine is easily cocked, shifted or tilted away from the centerline of the fluid supply inlet. In fact, even when no fluid is being passed through the spray head assembly, the wobble turbine may rest at a cocked angle relative to the centerline of the housing. In order to provide the most effective wobbling motion, it is desirable for the wobble turbine be shifted sufficiently away from the centerline of the fluid supply so that a major portion of the fluid supply is being directed at one side of the wobble turbine face. The loose fitting relationship allows the spray head assembly of the present invention to achieve a sufficient shifting of the wobble turbine within a much shorter axial distance than if the wobble turbine were integral to the spray nozzle assembly.

A still further aspect of the invention provides for one or more intermediate sleeves to be disposed post and sleeve described above. For a spray nozzle assembly having a post, a sleeve and one or more intermediate sleeves, it is preferred that the relationship between each member (post, sleeve and intermediate sleeve) provide for wobbling therebetween.

Another aspect of the invention provides a sufficiently open flow channel throughout the spray head assembly so that the fluid flow rate limiting restriction may be a flow control washer disposed in the spray head assembly near the fluid inlet and the size of the orifice just upstream of the outlet channels of the spray nozzle. In this manner, adequate pressure is maintained inside the housing to drive the wobble turbine, while adequate water velocity is generated at the fluid outlet to provide a satisfying shower.

Yet another aspect of the invention provides a spray head assembly having pins mounted in the outlet channels of the spray nozzle. The wobbling motion and forces of the spray nozzle cause the pins to rotate or vibrate in contact with the inside surface of the channels, thus eliminating any possibility of mineral build-up. The pins preferably have a head restrained in the spray nozzle and a shaft attached to the pin head extending through the outlet channels. It is important that the pin head and shaft do not block the flow of fluid through the outlet channel.

It should be recognized that the spray heads of the present invention, and the individual components thereof, may be made from any known materials that are resistant to chemical and thermal attack by the fluid passing therethrough. Where the fluid is water, the preferred materials include plastics, such as polytetrafluoroethylene, and metals or metal alloys, such as stainless steel. Other and further materials suitable for use in the present invention should be apparent to one of skill in the art and are considered to be within the scope of the present invention.

FIG. 1 is a cross-sectional view of a spray head assembly 40. The spray head assembly 40 has a housing 42 for holding a wobble turbine 44 and a wobble plate 46. The housing 42 forms a substantially water tight chamber 43 with an inlet 45 positioned upstream from the wobble turbine 44. The floor 50 of the housing 42 forms a collar, hole or opening 52 therethrough for sidably receiving a shaft 54 which is fixed to the wobble plate 46 inside the housing 42, and the spray nozzle 48 outside the housing 42. The shaft 54 is sealed within the bore 52 by a lip seal 56 to prevent leakage of water from the housing while allowing the shaft 54 to tilt and rotate within the opening 52. An o-ring may also be used to seal the shaft 54 in the opening.

The wobble turbine 44 has a conical upper surface 58 forming a plurality of non-radial channels 60 (see also FIG. 4) and a generally cylindrical sleeve 62. The upper surface 58 of the wobble turbine 44 preferably extends beyond the sleeve 62 to form an annular overhang 64 that faces the lower end 62. The sleeve 62 of the wobble turbine has an inside surface 68 defining an inside diameter that is larger than the outside diameter of the shaft 54. When assembled, the sleeve 62 slides over the shaft or post 54 and the wobble turbine 44 rests on top of the shaft 54. The wobble turbine 44 and the shaft 54 are preferably made from polytetrafluoroethelyene (PTFE), such as TEFLON a registered trademark of DuPont de Nemours, Wilmington, Del.), or other suitable polymer material, to allow for some friction between the wobble turbine 44 and the shaft 54 while allowing the wobble turbine 44 to move freely about the shaft 54.

The wobble plate 46 has a bottom surface 72 that tapers upwardly away from the floor 50 of the housing 42. The angle formed between the wobble plate 46 and the floor 50 determines the maximum degree of wobble experienced by the spray nozzle 48 by limiting the tilt of the spray nozzle assembly. Preferably, the bottom surface 72 of the wobble plate forms an angle of between about 1 and about 20 degrees with the floor 50 of the housing 42, more preferably between about 2 and about 10 degrees, and most preferably about 4 degrees, when the center line of the nozzle assembly is aligned with the center line of the housing. The tilt of the spray nozzle will be similarly limited, with the foregoing angle between the plate and the housing resulting in an increase of the effective spray width of the spray head by a factor of two times the angle, i.e., the same angular increase in all directions.

The shaft or post 54 provides a passage 74 in fluid communication with the shaft inlet(s) 76 and the spray nozzle 48. The inlet 76 is preferably a plurality of channels that extend through the wall of the post, preferably angled downwardly from the top of the housing 12 toward the floor of the housing. The passage 74 comprises a velocity tube 75 which limits the flow rate of fluid through the spray head in accordance with water conservation standards, such as 2.5 gallons per minute (GPM). The passage 74 then opens into fluid communication with the outlet channels 78 of the spray nozzle 48.

Therefore, fluid follows a pathway by entering the chamber 43 through the inlet 45, passing over the wobble turbine 44, entering through inlet 76 into the passage 74 in the shaft 54, and exiting the spray nozzle 48 through a plurality of spray channels 78 in flow communication with the passage 74 in the shaft 54. In operation, a fluid source under pressure is in communication with the inlet in the housing. The turbine wobbles due to the fluid impacting upon the upper surface of the wobble turbine. Wobbling means essentially that the wobble turbine tilts to one side and orbits about the central axis of the shaft so that the inside surface near the lower end of the wobble turbine is in rolling contact with the outside surface of the shaft. The wobble action of the wobble turbine exerts forces on the shaft which are translated to the wobble plate through the shaft, so that the bottom surface of the wobble plate is in rolling contact with the floor of the housing. The spray nozzle also wobbles in response to the wobbling movement of the shaft. Once the chamber is substantially filled with water, water therein enters the inlet in the shaft and flows through a passage in the shaft to the spray nozzle.

Figure 4:
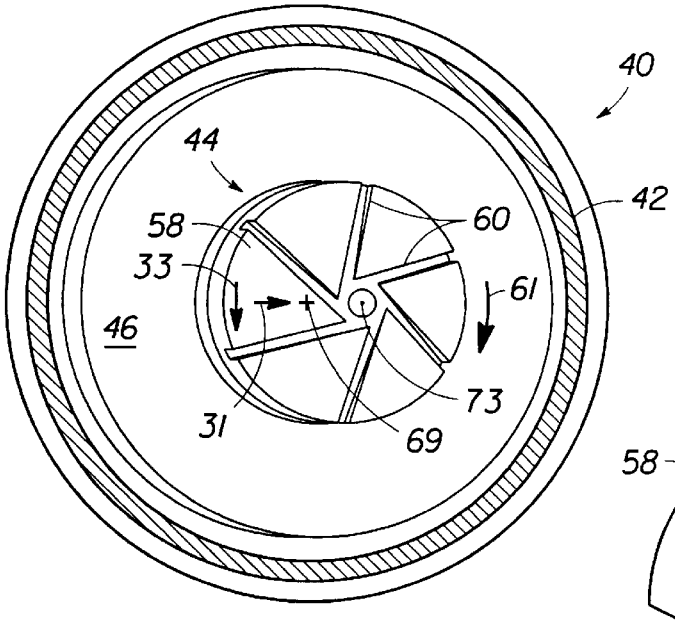
FIG. 4 is a cross-sectional top view of the spray head taken along line 4—4 showing the top of a wobble turbine.

FIG. 4 is a cross-sectional view of the spray head 40 taken along lines 4—4 of FIG. 1. The top surface 58 of the wobble turbine 44 is illustrated having grooves 60 formed in a non-radial configuration. It should be noted that fluid flow impacting upon the wobble turbine 44 will push the wobble turbine 44 aside into a tilting position so that the center point of the wobble turbine 44 is substantially out of the stream of fluid from inlet 45 and only one side of the wobble turbine 44 is aligned with the fluid stream at any point in time. Each of the channels or grooves 60 formed in the upper end 58 of the wobble turbine 44 are non-radial and act as vanes that cause the wobble turbine to orbit around the fluid inlet as fluid flows through the grooves. The non-radial grooves 60, the conical surface 58 and the loose relationship between the sleeve 62 and the post 54 ensure that when fluid flows against the top of the wobble turbine 44 under pressure, the wobble turbine 44 will tilt off center and start to wobble. More particularly, the fluid impinging on the conical surface 58 of the turbine 44 causes a tilting force 31 and the fluid passing through the grooves 60 causes rotational forces 33. Therefore, the fluid stream passing through the inlet 45 causes the wobble turbine 44 to wobble in the clockwise direction, as shown by arrow 61. Once the wobbling motion begins, the continued flow of water maintains the wobble turbine 44 in a wobbling mode. Furthermore, the flow of fluid also causes a hold down force which pushes downward on the turbine, tending to keep the turbine from being displaced from its cooperative relationship with the nozzle assembly. Therefore, it is preferred that the angle of the conical surface 58 be sufficiently great to produce at least a slight tilting force even when the turbine is already fully tilted, yet not so great as to cause the turbine to pull up and out of contact with the nozzle assembly.

Figure 12A:
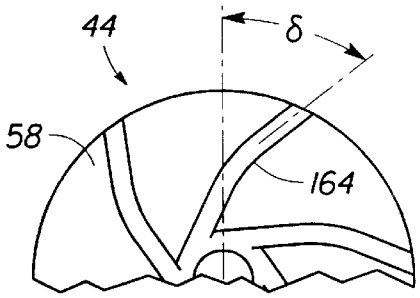
FIGS. 12A–B are partial top views of alternative wobble turbines having different groove angles.
Figure 12B:
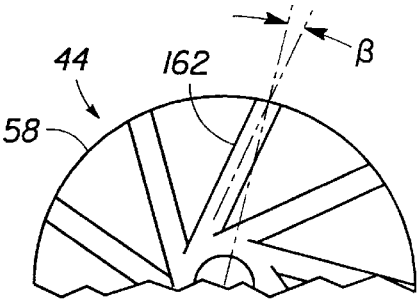

For any given wobble turbine, the wobble rate or speed may be increased (or decreased) by increasing (or decreasing) the flow rate of fluid through the spray head. However, it is possible to design the wobble turbine to have a faster or slower wobble rate for a given fluid flow rate by changing the angle or pitch of the grooves in the wobble turbine. Referring to FIG. 12, a wobble turbine may be designed to have a generally slower wobble rate by decreasing the pitch of the grooves, i.e., designing the grooves 162 at a small angle, $\beta$, from radial. Similarly, the wobble turbine may be designed to have a faster wobble rate by increasing the pitch of the grooves, i.e., designing the grooves 164 at a larger angle, $\delta$, from radial. Referring back to FIG. 4, the grooves may even be designed with a changing angle to form a "pin-wheel" type of pattern. Furthermore, the number and size of grooves may also be modified to customize a wobble rate.

FIGS. 17A–I are schematic diagrams illustrating the wobble movement between a wobble turbine sleeve 62 and nozzle assembly post 54 in accordance with the spray head 40 of FIG. 1. Starting with the turbine sleeve 62 and the post 54 tilted to the right of the housing 42, the turbine sleeve 62 and post 54 orbit clockwise around the housing centerpoint 69, illustrated here in 45 degree increments between Figures. Because the post 54 and turbine sleeve 62 always tilted in the same direction, their respective centerpoints 71,73 are substantially radially aligned with the housing centerpoint 69. As the turbine sleeve 62 orbits in the clockwise direction (as exhibited by the movement of the turbine centerpoint 71 around the housing centerpoint 69), the sleeve 62 forces the post 54 to tilt and orbit in the same clockwise direction (as exhibited by the movement of the post centerpoint around the housing centerpoint 69).

Referring briefly back to FIG. 1, the turbine 44 and turbine sleeve 62 contact the post 54 at three points: (1) the lower inside edge of the sleeve 62 in the direction of the tilt (i.e., to the right in FIG. 1), (2) an inside point near the upper end of the sleeve 62 in the direction away from the tilt (i.e., to the left in FIG. 2), and (3) the underneath side of the turbine. Because there are three points of contact, it is necessary for one or more of the points to slide in order for the turbine to wobble. Although all the points of contact are wetted by the fluid, such as water, prolonged use of the turbine may cause some marginal wear on the post or the inner surface of the sleeve.

FIGS. 10A–I are schematic diagrams illustrating the wobble movement between a wobble plate and housing floor of the present invention. Due to the angle formed between the wobble plate and the floor, a circle of rolling contact between the wobble plat and the floor define a first circle on the wobble plate 46 having a diameter 47 (and a circumference) that is different than the diameter 51 of a second circle on the floor 50 of the housing 42. In order to maintain contact with the floor, the wobble plate must make up for the difference in the circumferences by rotating. As shown, if the diameter of the circle 47 is less than the diameter of circle 51, then (in the absence of slippage between the wobble plate and the floor) the wobble plate 46 will rotate (as indicated by arrow 140) in a direction opposite to the wobble (as indicated by arrow 142). Each subsequent view in FIGS. 10A–I represent a wobble of 45 degrees clockwise.

Figure 10A:
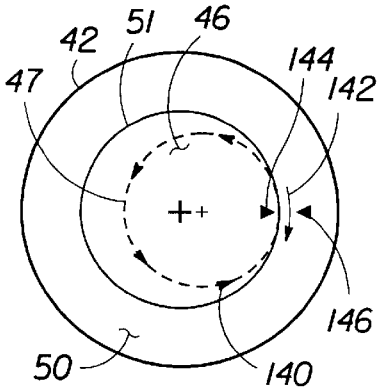
FIGS. 10A–I are schematic diagrams of the wobble movement between a wobble plate and housing floor of the present invention.
Figure 10B:
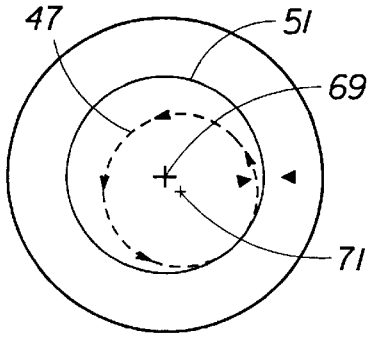
Figure 10C:
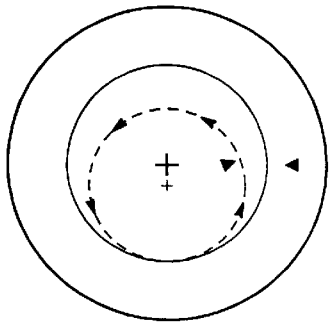
Figure 10D:
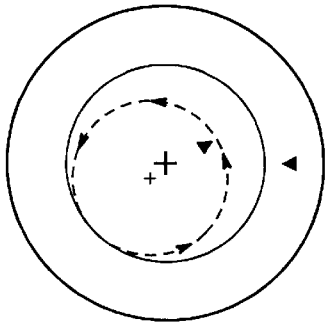
Figure 10E:
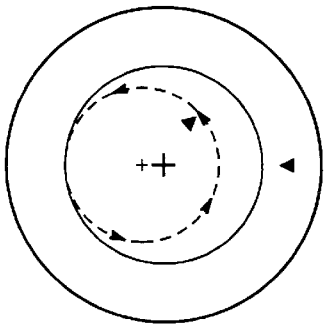
Figure 10F:
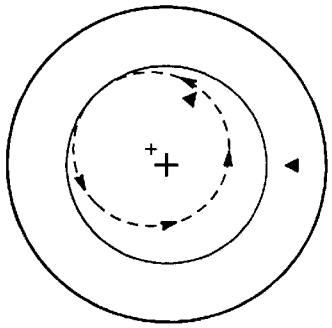
Figure 10G:
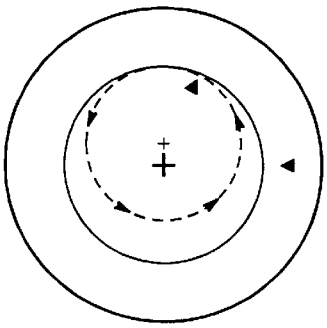
Figure 10H:
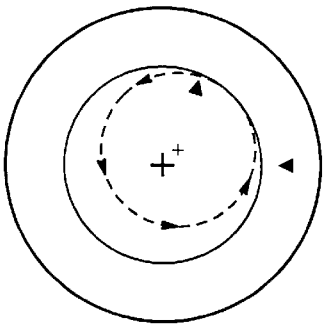
Figure 10I:
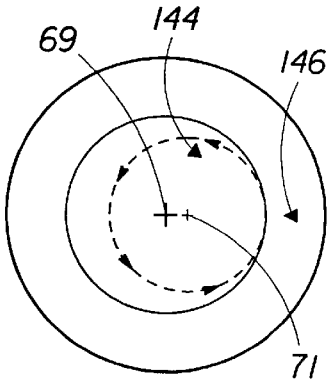
Figure 17A:
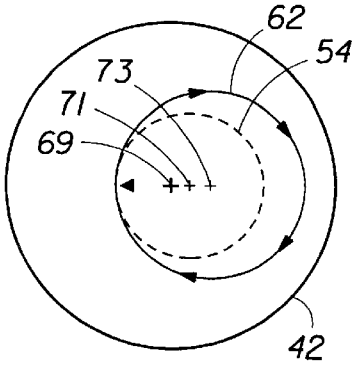
FIGS. 17A–I are schematic diagrams illustrating the wobble movement between a wobble turbine sleeve and nozzle assembly post in accordance with the spray head of FIG. 2.
Figure 17B:
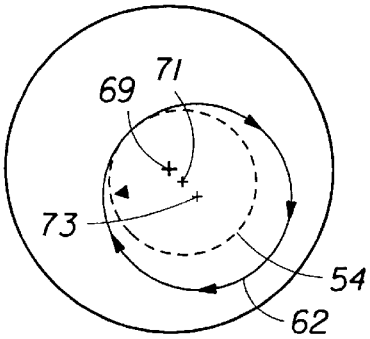
Figure 17C:
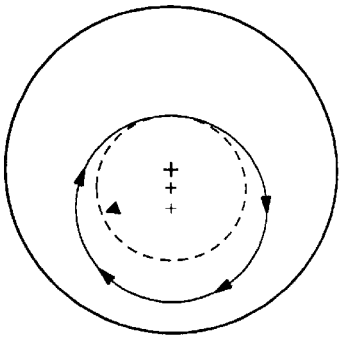
Figure 17D:
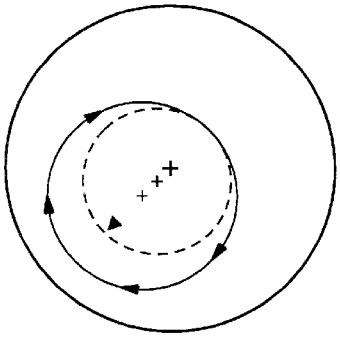
Figure 17E:
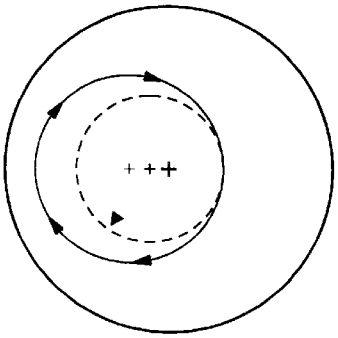
Figure 17F:
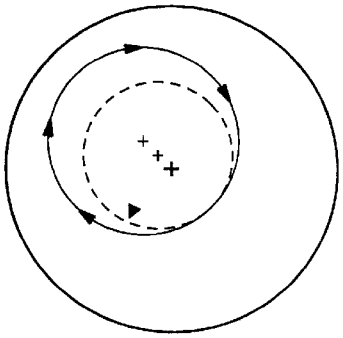
Figure 17G:
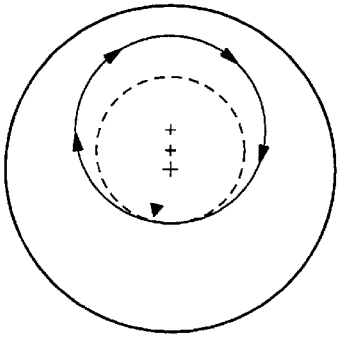
Figure 17H:
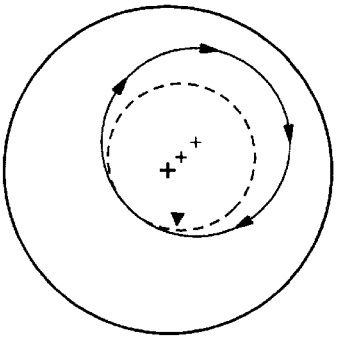
Figure 17I:
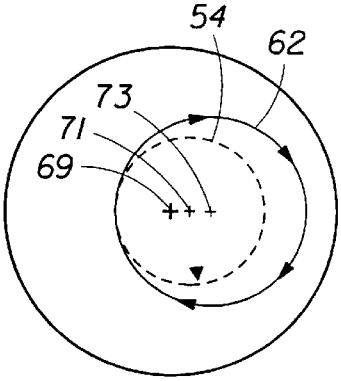
Figure 18A:
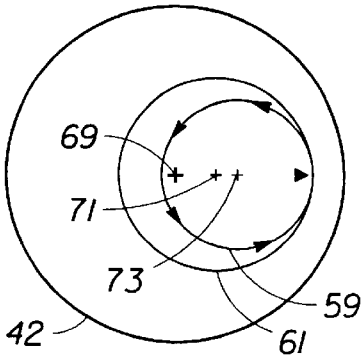
FIGS. 18A–I are schematic diagrams illustrating the wobble movement between a wobble turbine post and nozzle assembly sleeve in accordance with the spray head of FIG. 3.
Figure 18B:
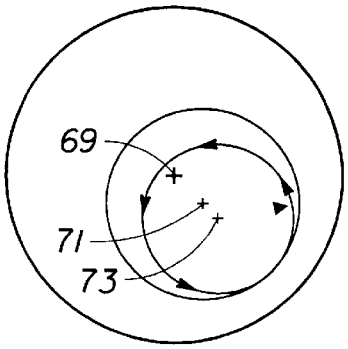
Figure 18C:
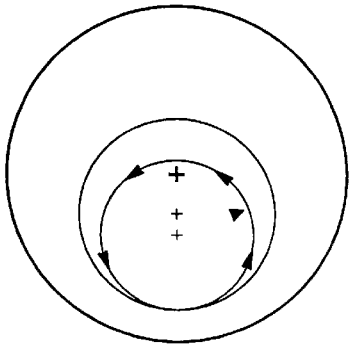
Figure 18D:
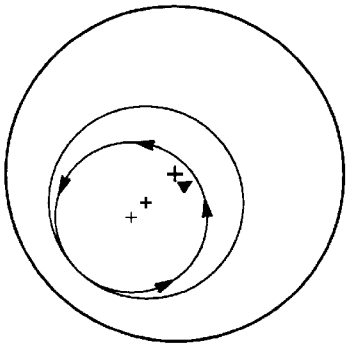
Figure 18E:
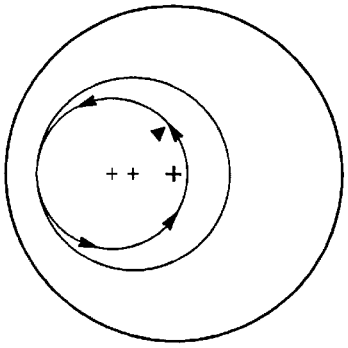
Figure 18F:
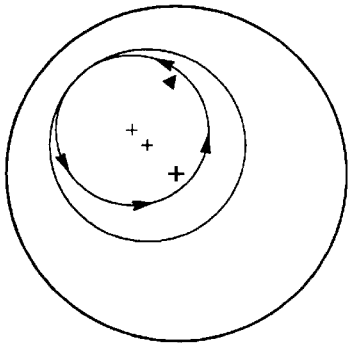
Figure 18G:
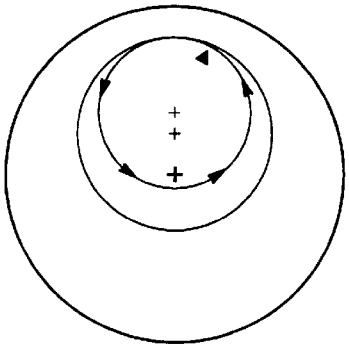
Figure 18H:
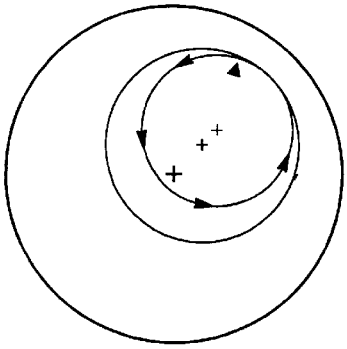
Figure 18I:
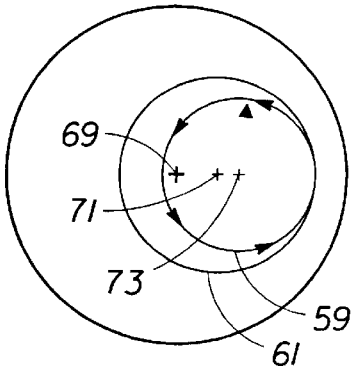

The wobble begins in FIG. 10A with the post (not shown) tilted down on the page so that the first circle 47 of the wobble plate is pushed over into contact with the circle 51 of the floor 50. For the purpose of illustration, two triangular markers 144,146 are placed on the wobble plate 46 and the floor 50, respectively, adjacent the initial point of contact between the circles 47, 51. As the wobble, and consequently the point of contact, moves clockwise, the wobble plate experiences a slight rotation counter-clockwise. For the given diameters 47, 51 shown in FIGS. 10A–I, it appears that during one full wobble, the wobble plate 46 rotates about one-quarter of a turn in the opposite direction to provide a wobble: rotation ratio of about 4. The rotation in this instance is in the opposite direction of the wobble because the diameter and circumference of circle 47 is less than the diameter and circumference of circle 51 (i.e., $D_3>D_4$). It should also be recognized that the floor itself could be frustoconical. It should be recognized that the wobble:rotation ratio may be increased by providing a greater difference in the diameters of, or the angles between, the wobble plate and the floor. The principals governing the wobble:rotation ratio just described with respect to the wobble plate and floor also hold true for the wobble inducing member or wobble turbine and the post.

Referring back to FIG. 1, the post 54 is surrounded by two intermediate sleeves 80,82 (the use of intermediate sleeves is optional) that have a diameter greater than the shaft 54 and a less than the sleeve 62 of the wobble turbine 44. The sleeves 80,82 wobble (i.e., tilt and rotate about the shaft) when contacted by the inside surface 66 of the wobble turbine 44. The addition of the sleeves allows the wobble turbine to tilt to the desired angle while maintaining a small contact angle between surfaces.

The post or shaft 54 also includes a sipping channel 84 that opens into an annular cup 86 in the spray nozzle 48 in proximity to the opening 52. The sipping channel 84 catches any water that may leak from around the opening 52 and the instance where no seal is used. The vacuum created by the water exiting the outlet channels 78 pulls water from the cup 86 through the sipping channel 84 and into the passage 74. Channels 84 also supply air to the space below the velocity tube 75, thus allowing the water stream exiting the velocity tube 75 to maintain its velocity while being deflected and guided down channels 78.

Figure 2:
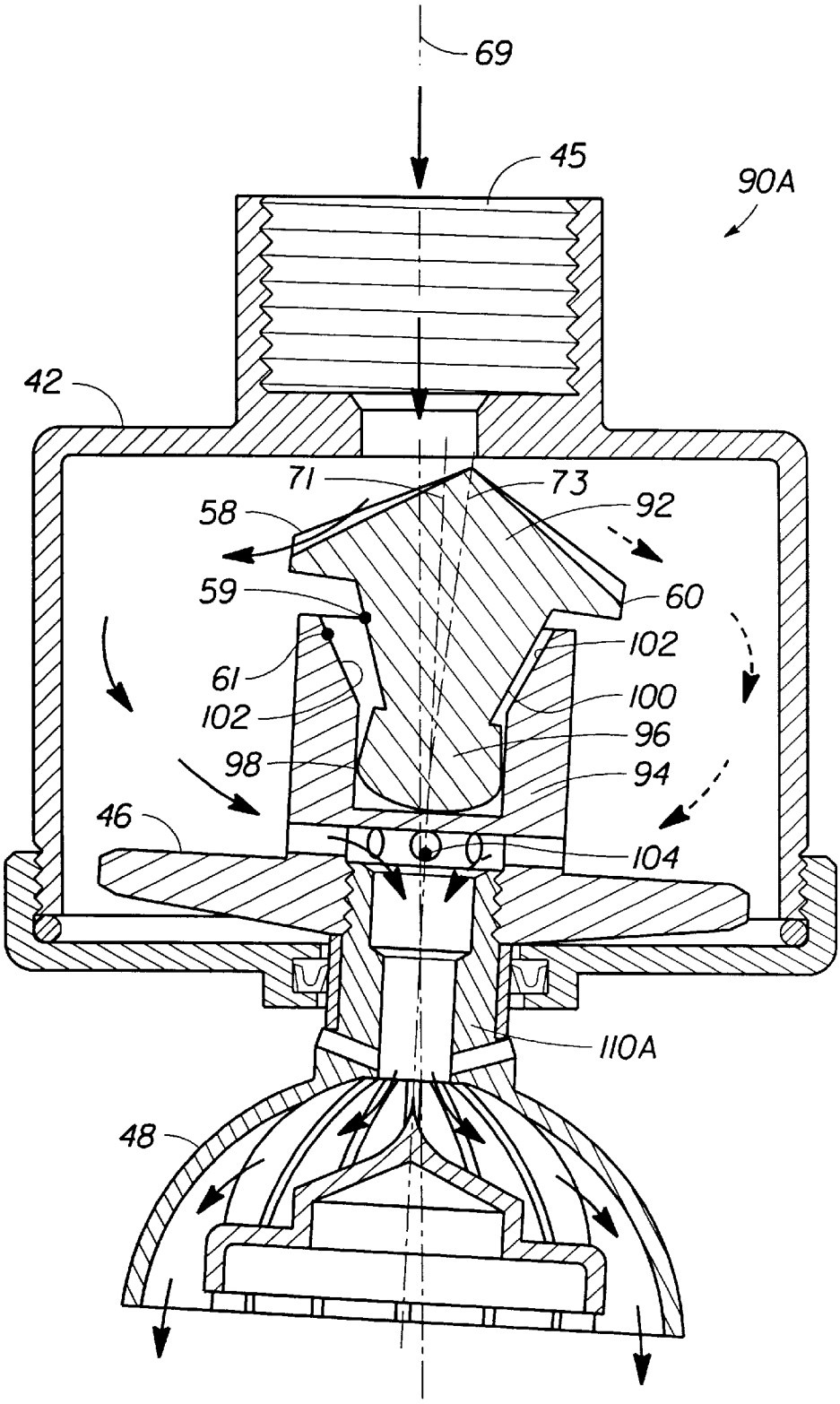
FIGS. 2 and 3 are cross-sectional side views of a second embodiment of a spray head assembly of the present invention.

FIG. 2 is a cross-sectional view of a second embodiment of a spray head assembly. The spray head 90A is substantially the same as spray head 40 of FIG. 1, except for the relationship between the wobble inducing member or wobble turbine 92 and the distal end 94 of the spray nozzle assembly. In accordance with a previous discussion, the wobble turbine 92 includes a post 96, rather than a sleeve, and the distal end 94 includes a sleeve 98, rather than a post. Furthermore, the post 96 and sleeve 98 illustrate the use of frustoconical surfaces 100 and 102, respectively, most preferably having a common pivot point 104 somewhere along the centerline. As with the previous wobble turbine 44, fluid flow from inlet 45 impacts the surface 58 and tilts the wobble turbine 92 to one side until the surfaces 100, 102 make contact. The fluid flow through the grooves 60 on one side of the turbine imparts tangential forces on the wobble turbine 92 (as described in regard to FIG. 4) causing the wobble turbine to wobble within the sleeve 94. The rolling component of the wobbling motion can be more easily visualized in this configuration of spray head 90 than in the configuration of spray head 40, probably because the contact between the turbine post 96 and the sleeve 98 is substantially a line rather than the three points of contact exhibited by the turbine 44 of FIG. 1.

Figure 3:
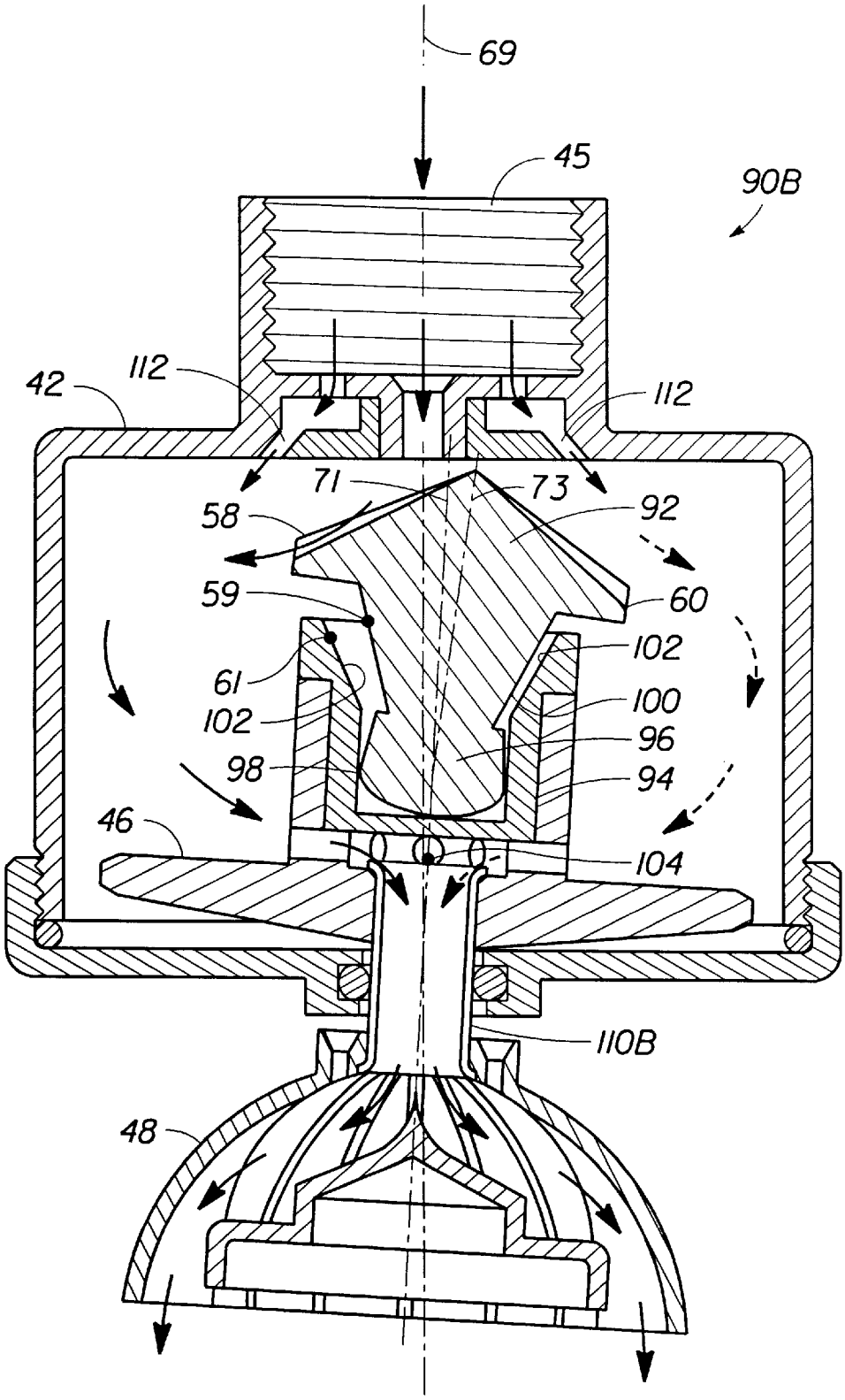

FIGS. 18A–I are schematic representations of the wobble movement between the wobble turbine post 96 and nozzle assembly sleeve 98 in accordance with the spray head 90A of FIG. 3. Because the diameter of circle 59 formed on the surface of the turbine 96 is less than the diameter of circle 61 formed on the opposing surface of the sleeve 98, as the turbine 96 wobbles clockwise, the turbine 96, exemplified by circle 61, will rotate in the counter-clockwise direction. The spray head 90A is preferred over the spray head 40 because the wear associated with the three point contact is eliminated. It is believed that the reduced wear is a combined result of eliminating the three point contact and allowing the nozzle assembly rotation (counter-clockwise for a clockwise wobble as shown in FIGS. 10A–10I) to match the turbine rotation (counter-clockwise for a clockwise wobble). Because the post 96 and sleeve 98 rotate in the same direction, the amount of friction therebetween is significantly reduced or possibly ellininated. Although the spray head 90 is shown with the post 96 and sleeve 98 having the more preferred frustoconical surfaces, it is also suitable to make the post 96 and sleeve 98 having simple cylindrical surfaces.

FIG. 3B is a cross-sectional view of the spray head of FIG. 3A with two modified features. First, the spray head 90B incorporates a nozzle assembly having a thin walled tube 110B coupling the wobble plate 46 to the spray nozzle 48. The thin walled tube is preferable made of a very rigid material, preferably a metal such as stainless steel, in order to reduce the outer diameter of the tube 110B (as compared with the tube 110A in FIG. 90A). For example, the tube may comprise a stainless steel tube having an inner diameter of about 0.15 inch and an outer diameter of about 0.18 inch. Reducing the outer diameter of the tube 110B reduces the amount of force required to tip or tilt the nozzle assembly.

Second, the spray head 90B is shown having one or more bypass channels or slots 112 to divert a portion of the fluid flow around the turbine 60. The bypass channels 112 may be desirable to reduce the forces applied on the turbine by the water, and consequently reduce the forces applied between the turbine and the nozzle assembly and between the nozzle assembly and the floor and the like, to the amount of forces need to the reliably maintain a wobble. It is believed that unnecessarily high forces might cause increased wear between the moving members of the spray head and the generation of noise.

Figure 5:
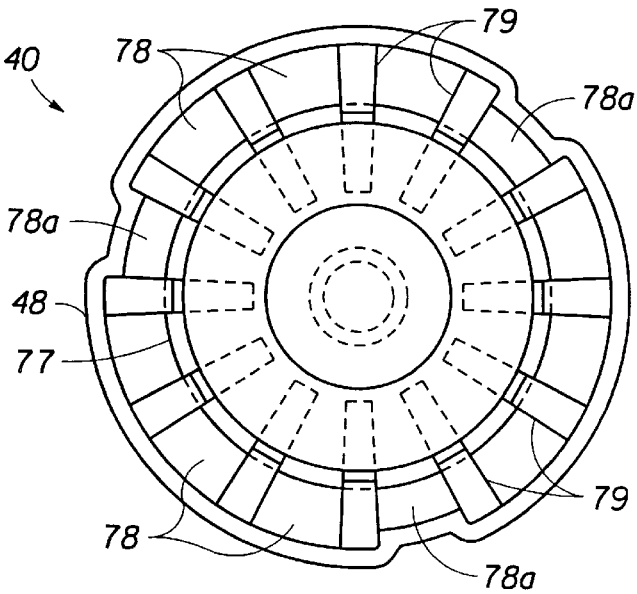
FIG. 5 is a bottom view of the spray head showing the outlets from the spray housing.

FIG. 5 is a bottom view of the spray head showing the outlets of the spray nozzle. While the outlet channels may be provided in any manner known in the art, a preferred set of outlet channels 78 are defined by a plurality of fins 79 connected to a deflector 77. The primary purpose of the deflector 77 is to provide an curved path for the water to flow through the spray nozzle. It is preferred to direct a minor portion of the outlet channels 78 at a lesser angle to the axis of the spray nozzle 48 in order to provide more even spray pattern or coverage over an object at a short distance from the spray head, such as a person taking a shower. Lesser angle outlet channels 78*a* are preferably formed at spaced intervals around the perimeter of the spray nozzle or at locations radially inward toward the central axis of the spray nozzle (not shown).

Figure 6:
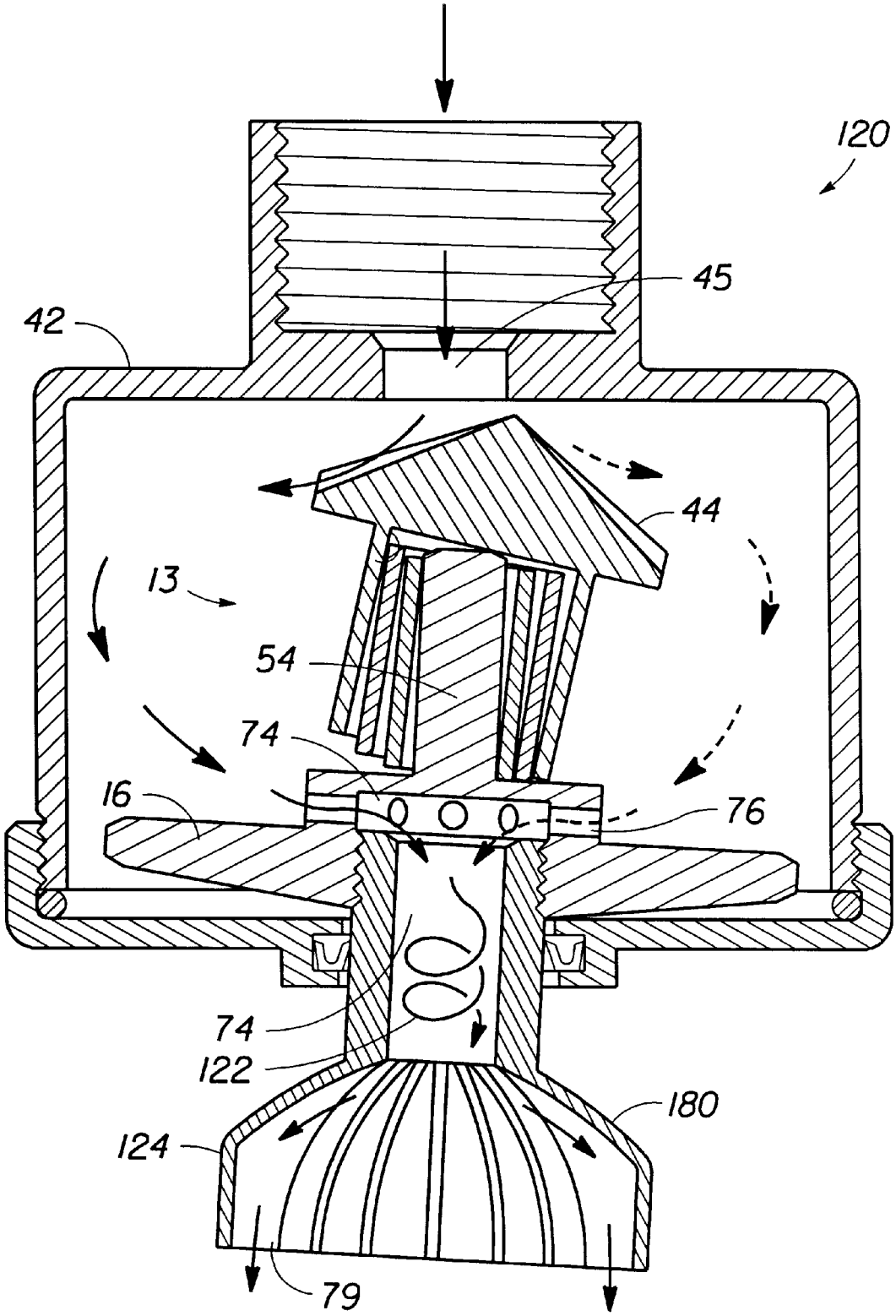
FIG. 6 is a cross-sectional view of a third embodiment of a spray head assembly of the present invention.

FIG. 6 is a cross-sectional view of a shower head assembly 120, in which like numerals label similar elements of the previous embodiment illustrated in FIG. 2. The inlet channels 76 in the post 54, extend into the passage 74 forming a tangential angle with the central axis the post 54 and the passage 74 that causes the fluid to swirl. The swirling or spiraling fluid 122 passes through the passage 74 to the spray nozzle 124. Since the momentum of the swirling fluid forces the fluid outward against the walls of the passage 74 and spray nozzle 124, there is no deflector required. Preferably, the spray nozzle still includes fins 79 to reduce or eliminate the swirling of the fluid and define a number of fluid streams exiting the spray nozzle. Most preferably the fins are set to cause fluid to exit at a 5° angle with the central axis of the post.

Figure 7:
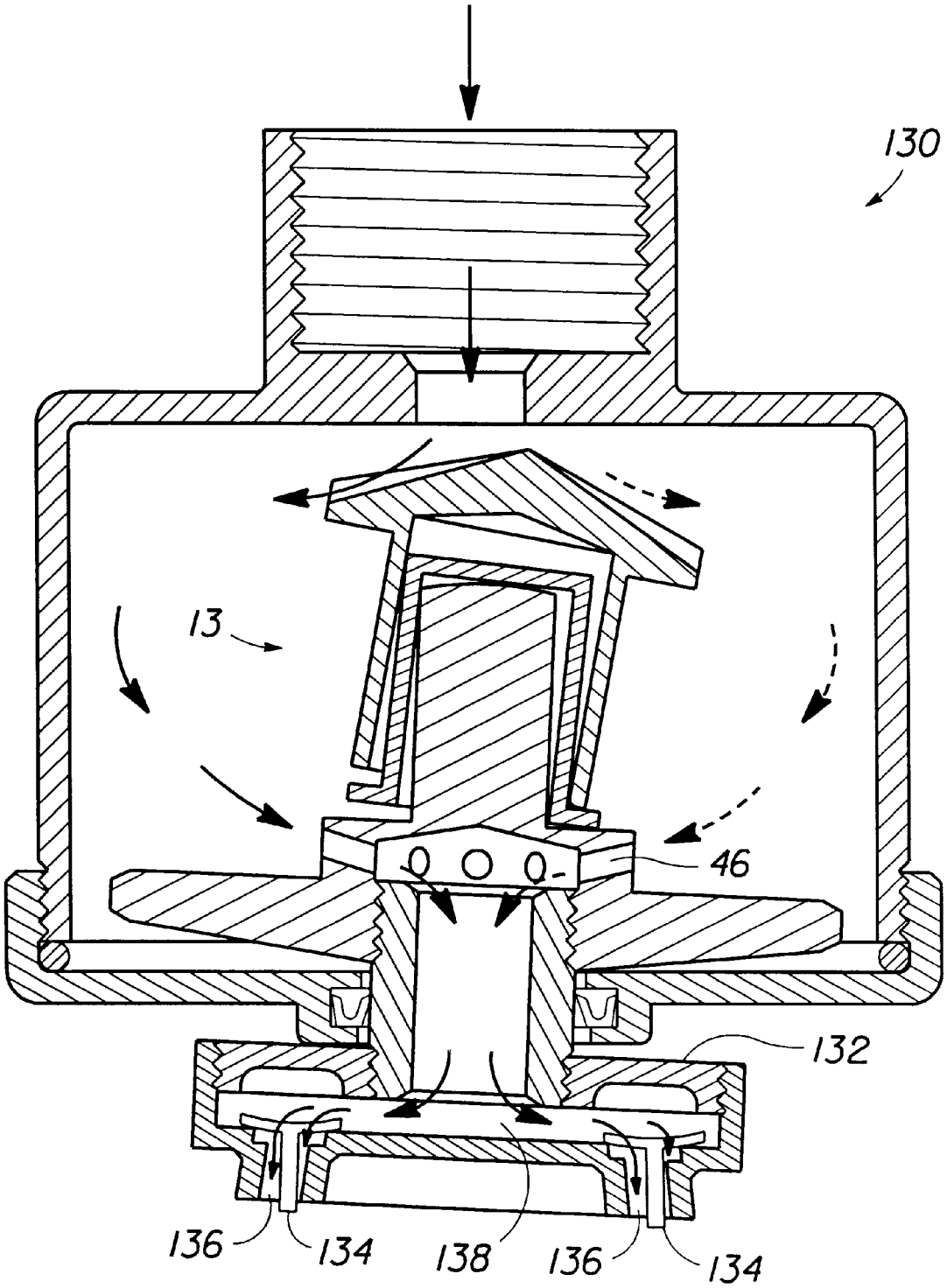
FIG. 7 is a cross-sectional side view of a fourth embodiment of a spray head assembly of the present invention

FIG. 7 shows a cross-sectional view of an alternative spray head 130 constructed and operative in accordance with a preferred embodiment of the present invention, and in which like numerals label similar elements of the previous embodiment illustrated in FIG. 2. The spray head 130 has a spray nozzle 132 with pins 134 positioned in the outlet channels 136. The pins 134 have a head at one end disposed within the chamber or passage 138 and a generally straight stem that extends downwardly into or through the outlet channels 136. The centrifugal force generated by the wobbling spray nozzle causes the pins 134 to rub and keep the sides of the outlet channels 136 clear of lime and other mineral deposits. This self-maintenance feature is very useful in areas where the water has a high concentration of lime and other minerals and a pressurized spray head is desired.

Figure 8A:
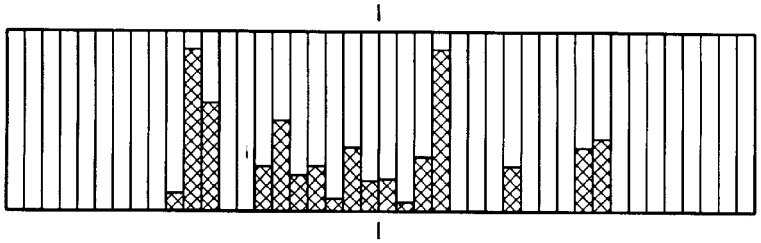
FIGS. 8A–D and 9A–D are graphical representations of the uniformity of the spray patterns from four spray heads, including a spray head of the present invention, at two different distances from the spray head.
Figure 8B:
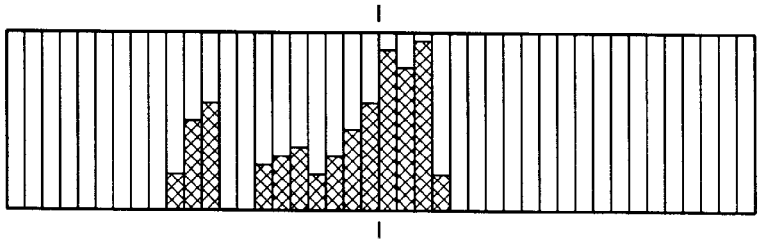
Figure 8C:
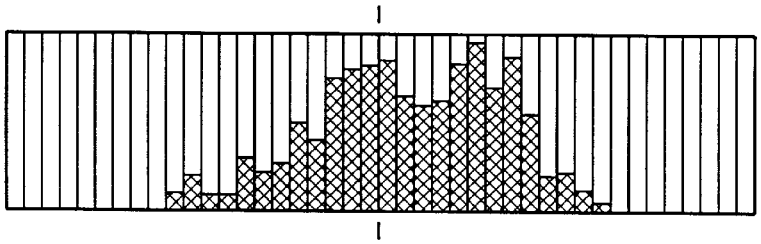
Figure 8D:
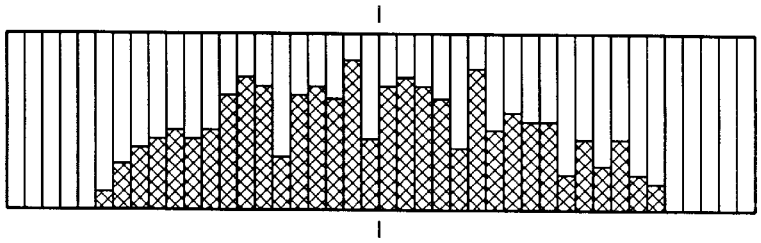
Figure 9A:
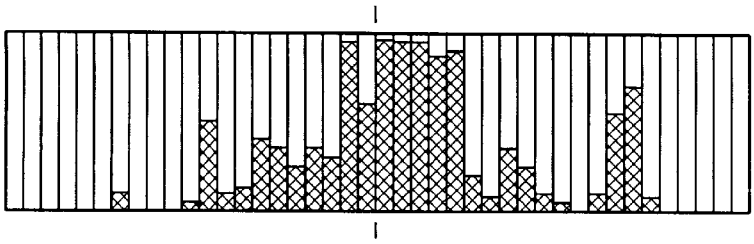
Figure 9B:
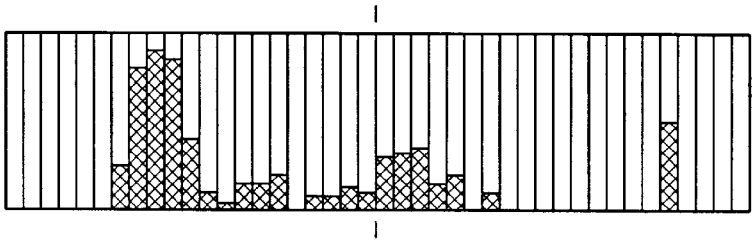
Figure 9C:
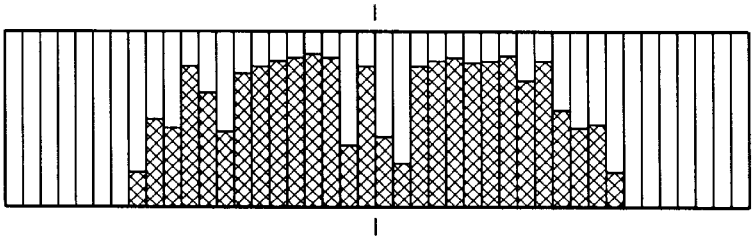
Figure 9D:
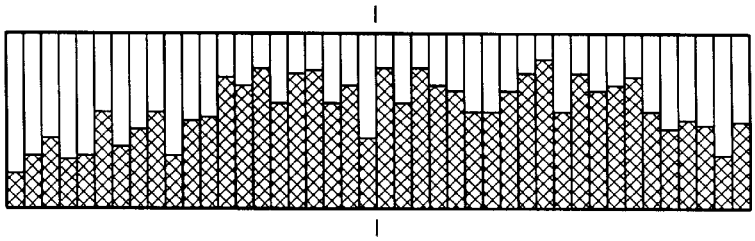

FIGS. 8A–D are graphical representations of the uniformity of the spray patterns from four shower heads, including three commercially available shower heads (FIGS. 8A–C) and a shower head made in accordance with FIG. 2 of the present invention (FIG. 8D), at one distance from the spray head. FIGS. 9A–D are similar graphs prepared using the same four shower heads, but at a greater distance. Each of the spray heads were connected to a constant pressure source of water and directed generally downward onto a row of glass tubes each having a diameter of about ¼ inch The results of this experiment are shown in the graphs as a side view of the liquid collected in the tubes. It is clear that the results shown in FIGS. 8D and 9D provides the most uniform distribution of water across the width of the spray pattern. The other graphs show a tendency to concentrate the water delivery at a point or small sub-region of the spray pattern.

FIGS. 11A and 11B are schematic side views of a spray head 40 in accordance with FIG. 2 and the pattern of water delivered by the spray nozzle 48. If the spray nozzle 48 were held stationary, a spray width defined by dashed lines 150 would result in accordance with the design of the spray nozzle itself. When the spray nozzle 48 is allowed to wobble in accordance with the present invention, the spray width increases by $2\alpha$, where $\alpha$ is the same angle as that angle between the wobble plate and the floor (See FIG. 2). FIG. 11 also illustrates the unique spray pattern which may be viewed with the naked eye. The rapid wobbling of the spray nozzle 48 causes the individual droplets or streams to break up and spread out over an arcuate path. For example, assume the spray nozzle has twelve outlet channels: three outlet channels 78*a* directed at 2° off center and nine channels directed at 6° off center. If the spray head is designed to have a 2° wobble, i.e., by providing a 2° angle between the wobble plate and the floor, then a total spray angle (i.e., the angle between dashed lines 150) of 16° will be achieved. Because a 2° wobble will provide 4° of deflection (i.e., 2° in all directions), the three outlet channels directed at 2° will spray fluid at angles covering 0°–8° from the axis, which represents one quarter of the area showerhead, and the nine outlet channels directed at 6° will spray fluid at angles covering 8°–16°, which is three quarters of the shower area. It should be noted that many other outlet channel arrangements and designs may be used in accordance with the present invention.

FIG. 13 is a cross-sectional view of a alternative shower head assembly 160 constructed and operative in accordance with a preferred embodiment of the present invention, and in which like numerals label similar elements of the previous embodiment illustrated in FIG. 2. The shower head assembly 160 has a housing 42 for holding a wobble turbine 44 and a wobble plate 46. The housing 42 forms a chamber 43 with an inlet 45 positioned upstream from the wobble turbine 44. The floor 50 of the housing 42 forms a hole or opening 52 therethrough for slidably receiving a shaft 54 which is fixed to the wobble plate 46 inside the housing 42, and the spray nozzle (not shown) outside the housing 42. The shaft 54 is sealed within the bore 52 by a lip seal 56 to prevent leakage of water from the housing while allowing the shaft 54 to tilt and rotate within the opening 52. An o-ring may also be used to seal the shaft 54 in the opening. It should be noted that the opening 52 in all the embodiments described herein is wide enough to allow the shaft to rotate and pivot about the centerline of the housing so that the described wobbling motion can take place. While the housing 42 is preferably substantially fluid tight, some passage of fluid between the shaft 54 and the opening 52 is anticipated and is within the scope of the present invention.

The wobble turbine 44 has a conical upper surface 58 having a plurality of radially extending vanes 164 and a generally cylindrical sleeve 62. The vanes 165 are preferably tapered downwardly and toward the centerline of the turbine 44, similar to a propeller. The vanes 165 and the slanted or flustoconical surface 167 act to induce the wobble motion of the wobble turbine when contacted with a stream of water, much like the grooves of the wobble turbine shown in FIG. 2. In order to limit the degree of wobble, there is provided a wobble limiting element 166 which can be a ring mounted around the perimeter of the vanes 165 as shown or the ends of each vane 165 can be formed so that they are facing upstream as shown in FIGS. 15 and 16. The wobble limiting element 166 acts to limit the degree to which the wobble turbine tilts on the shaft, to achieve a similar result as the wobble plate described above. Preferably, the wobble limiting element 166 forms a frustoconical surface 169 that is inverted with respect to the frustoconical surface 167 so that the passage defined between the surfaces 167,169 is urged to stay in alignment with the fluid entering the housing 42 from the jet 171, even as the turbine 44 wobbles. For example, if the turbine 44 is in a substantially vertical position, then the fluid passing through the jet 171 will push against the surface 167 and cause the turbine 44 to tilt to the side. However, when the turbine 44 tilts sufficiently that the surface 169 of the wobble limiting member 166 is drawn into the flow of fluid passing through the jet 171, then the fluid pushes against the surface 169. Preferably, the surfaces 167,169 are designed with sufficient angles and surface areas so that the tilt of the turbine is limited. It should also be recognized that the vanes 165 may extend between the surfaces 167,169 either exactly radially (as shown in FIG. 14) or at some angle off-radial. Vanes having a greater angle off-radial may be designed to more correctly propel the turbine in a desired orbit without such heavy reliance, or perhaps any reliance, on a tracking ring to limit the degree of tilt. Furthermore, it may be useful to provide grooves or ridges on the surface 167 of the tracking ring in order to increase the relative force that is placed upon the tracking ring.

The wobble turbine 44 preferably forms a plurality of openings 168 that are in fluid communication with the passage 74 in the shaft 54. The sleeve 62 of the wobble turbine has an inside surface 68 defining an inside diameter that is larger than the outside diameter of the shaft 54. When assembled, the sleeve 62 slides over the shaft 54 and the wobble turbine 44 rests on top of the shaft 54. The wobble turbine 44 and the shaft 54 can be made from TEFLON or other suitable polymer material to allow for some friction between the wobble turbine 44 and the shaft 54 and so that the wobble turbine 44 can move freely about the shaft 54. The vanes can essentially replace the wobble plate, described previously, due to the fact that the ring compensates and controls the amount of wobble experienced by the shaft and the spray nozzle. The wobbling motion in this embodiment is the same as that described above in FIGS. 10A–I.

FIG. 14 is a top view of the wobble turbine 44 shown in FIG. 13. The vanes 165 are positioned an angle such that when the fluid flow from the inlet strikes the vanes, the wobble turbine will tilt to one side and begin to wobble. The wobble limiting element 166 in this embodiment is a tracking ring. The ring tapers downwardly, and has an outer diameter that is larger than the outer diameter of the water inlet upstream. The tracking ring acts to limit the wobble motion of the turbine much like the wobble plate described above.

FIGS. 15 and 16 are cross-sectional and top views respectively of a sixth embodiment of the present invention, constructed and operative in accordance with a preferred embodiment of the present invention, and in which like numerals label similar elements of the previous embodiment illustrated in FIG. 13. The wobble turbine 44 has a plurality of tapered vanes 165 that cause the wobble turbine to tilt to one side and begin wobbling upon contact with water from the inlet. The tapers on the vanes act to limit the wobble of the wobble turbine 44. The wobbling motion using the tracking ring and/or the tapered vanes is the same as that described above in FIGS. 10A–I.

Figure 19:
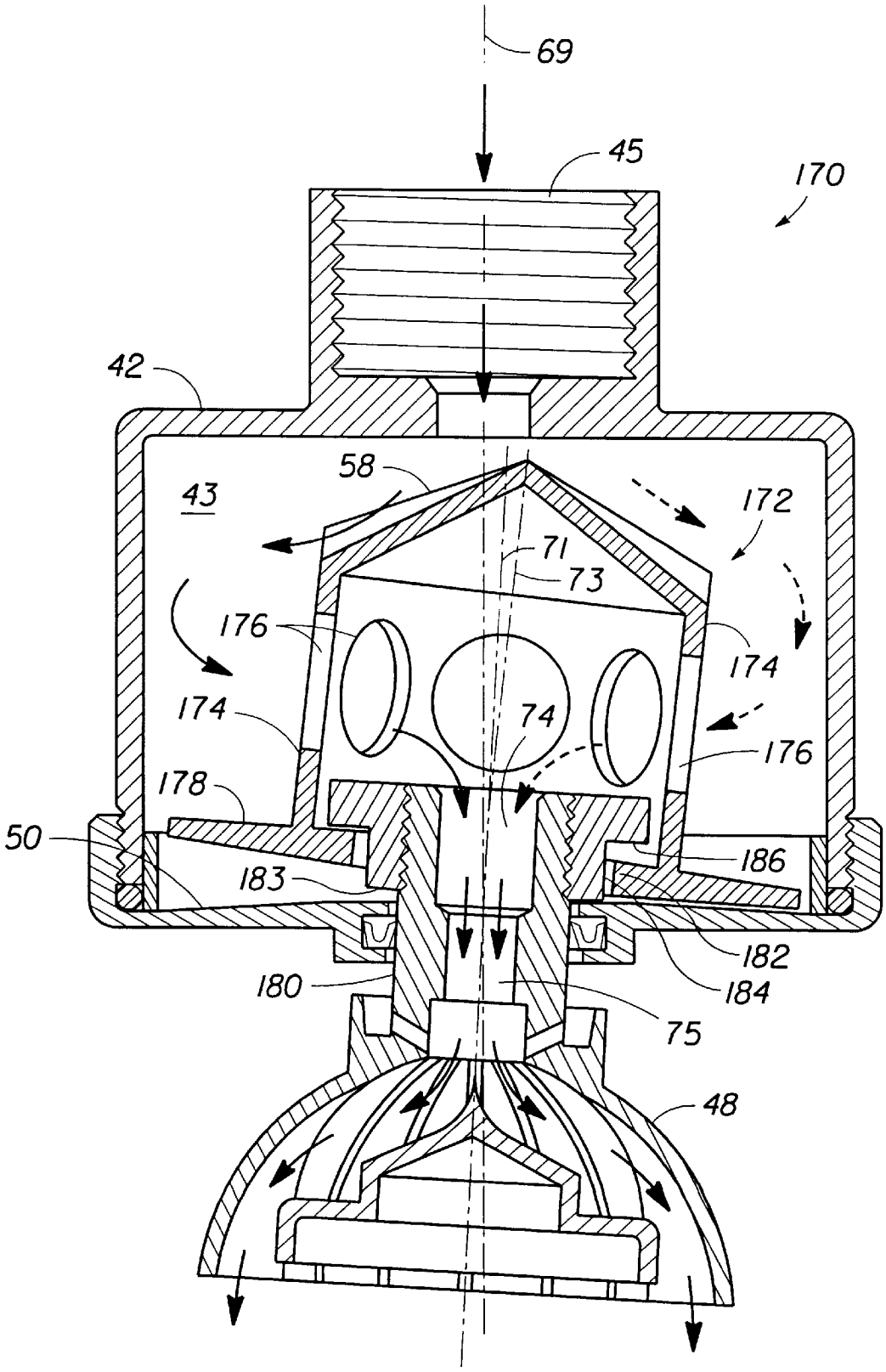
FIG. 19 is a cross-sectional side view of a seventh embodiment of a spray head assembly of the present invention.

FIG. 19 is a cross-sectional side view of a fifth embodiment of a spray head assembly of the present invention and in which like numerals label similar elements of the previous embodiment illustrated in FIG. 2. The spray head 170 includes a lifting turbine 172 having a top surface 58 with grooves 60 as with other previously discussed embodiments of the invention. The lifting turbine 172 also has a sleeve 174 with fluid passages 176 therethrough and a wobble limiting member or plate 178 attached to the end of the sleeve 174 opposite the turbine surface 58. While the wobble plate 178 will wobble on the floor 50 as described in FIGS. 10A–I, the wobble plate 178 is part of the turbine 172, instead of the nozzle assembly 180 as with other embodiments disclosed herein. Rather, the turbine 172 itself will wobble according to FIGS. 10A–I.

The wobble plate 178, or alternatively another portion of the sleeve, includes an annular lifting ring 182, shown here as an inward annular lip, that is disposed in a constrained position to a mating annular groove 184 in a portion of the nozzle assembly 180, such as the upper portion of the post. In this manner, the wobbling action of the turbine 172, wobble plate 178 and lip 182 cause the lip 182 to lift and lower one side of the nozzle assembly 180 at a time through contact with the upper wall 186 of the groove 184 and cause the nozzle assembly 180 to wobble on the wobble limiting surface 183. As the wobble plate 178 wobbles, the lip 182 will maintain one point of contact with the surface 186 of the nozzle assembly 180 and the wobble plate 178 will maintain another point of contact with the floor 50, where the two points are on generally opposite sides of the spray head axis 69.

Figure 20:
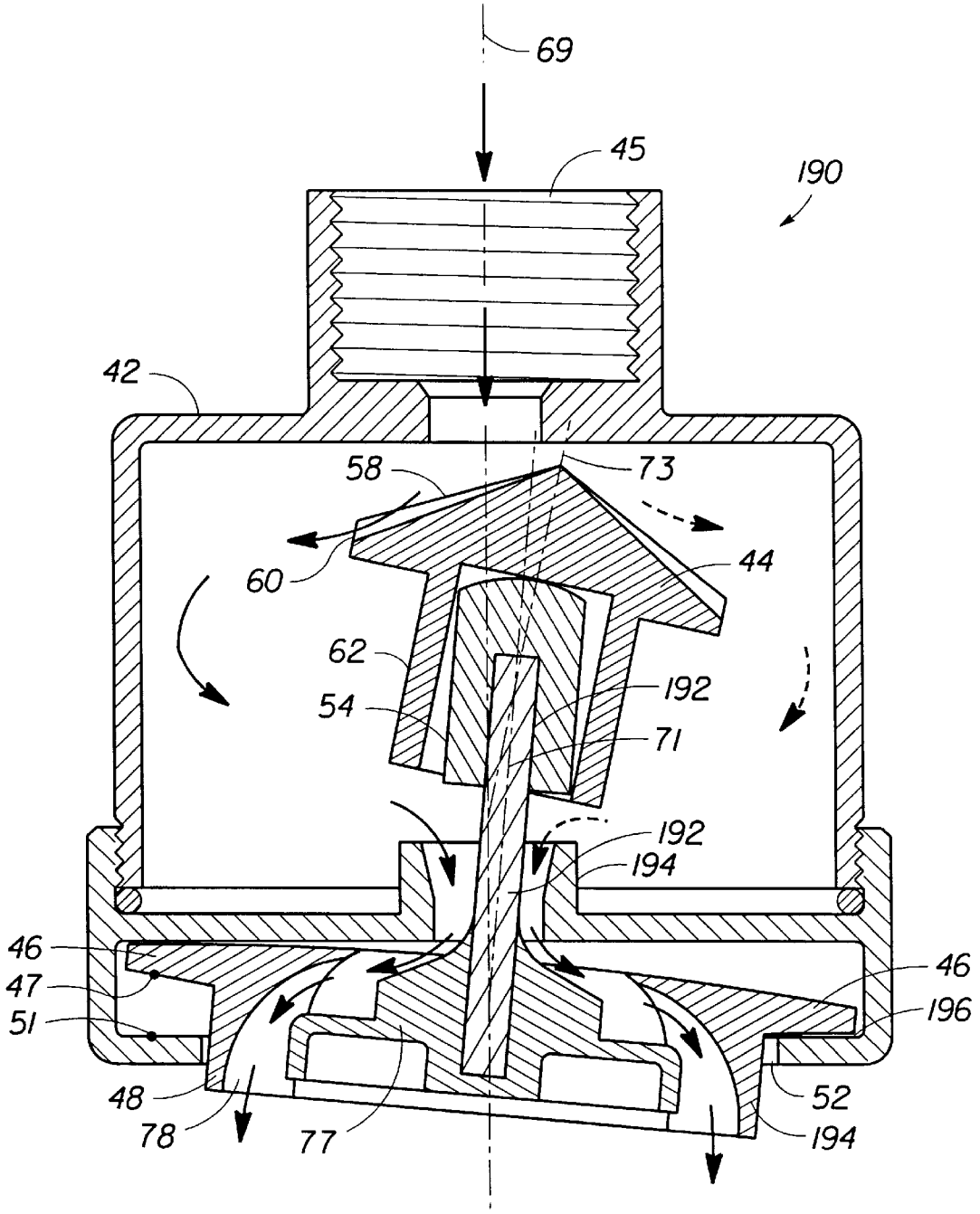
FIG. 20 is a cross-sectional side view of a eighth embodiment of a spray head assembly of the present invention.

FIG. 20 is a cross-sectional side view of a sixth embodiment of a spray head assembly in which like numerals label similar elements of the previous embodiment illustrated in FIG. 2. The spray head 190 includes a turbine 44 having a top surface 58 with grooves 60 as with other previously discussed embodiments of the invention. The turbine 44 also includes a sleeve 62 that is disposed over a post 54 of a nozzle assembly. The nozzle assembly of spray head 190 includes an elongate rod 192 having a first end supporting the post and a second end secured to a spray nozzle 194. The spray nozzle or housing 194 is similar to nozzle 48 of FIG. 2 in that nozzle 194 includes a deflector 77 and outlet channels 78. However, spray nozzle 194 also includes an integral wobble limiting member 46 which wobbles on a surface 196 of the housing 42. Note that the wobbling movement of the wobble limiting member 46 on the surface 196 is consistent with the description of FIGS. 10A–I and the wobbling movement of the turbine 44 on the post 54 is consistent with the description of FIGS. 17A–I. One advantage of the spray head 190 is that the seals 56 may be eliminated and the collar 52 is widened to receive the spray nozzle 48. It is preferred that the housing 42 further include a conduit 194 directing fluid flow around the rod 192 and into cooperation with the outlet channels 78 of the spray nozzle 48. Most preferably, the fluid passageway defined between the conduit 194 and the spray nozzle 48 are aligned so that the fluid passes smoothly from the conduit to the outlet channels.

Method and Apparatus for Controlling Fluid Delivery

The present invention provides a method and apparatus for altering the fluid delivery characteristics of a spray head having a moving spray nozzle, preferably a wobbling spray nozzle. A user can alter the fluid delivery characteristics of the spray nozzle by manipulating various simple interfaces, including push buttons, knobs with cams attached thereto, and other simple devices for manipulating or limiting the movement of the spray nozzle. More particularly, as described previously, the present invention delivers fluid through a nozzle assembly that is coupled to, integrally formed with, or at least in a cooperative relationship with, a motion inducing member. Therefore, altering or controlling the movement of the motion inducing member or the movement of the nozzle assembly itself can be made to alter or control the delivery of fluid from the nozzle assembly. The present invention alters or controls movement of the nozzle assembly by either (a) changing the forces acting upon the motion inducing member (i.e., increasing, decreasing, redirecting the flow of fluid relative to the motion inducing member), (b) limiting the range of motion that the motion inducing member can traverse (i.e., constraining or loosening the physical boundaries of the motion inducing member, either directly or indirectly), (c) limiting the range of motion that the nozzle assembly can traverse, or (d) some combination of (a) through (c).

Figure 21:
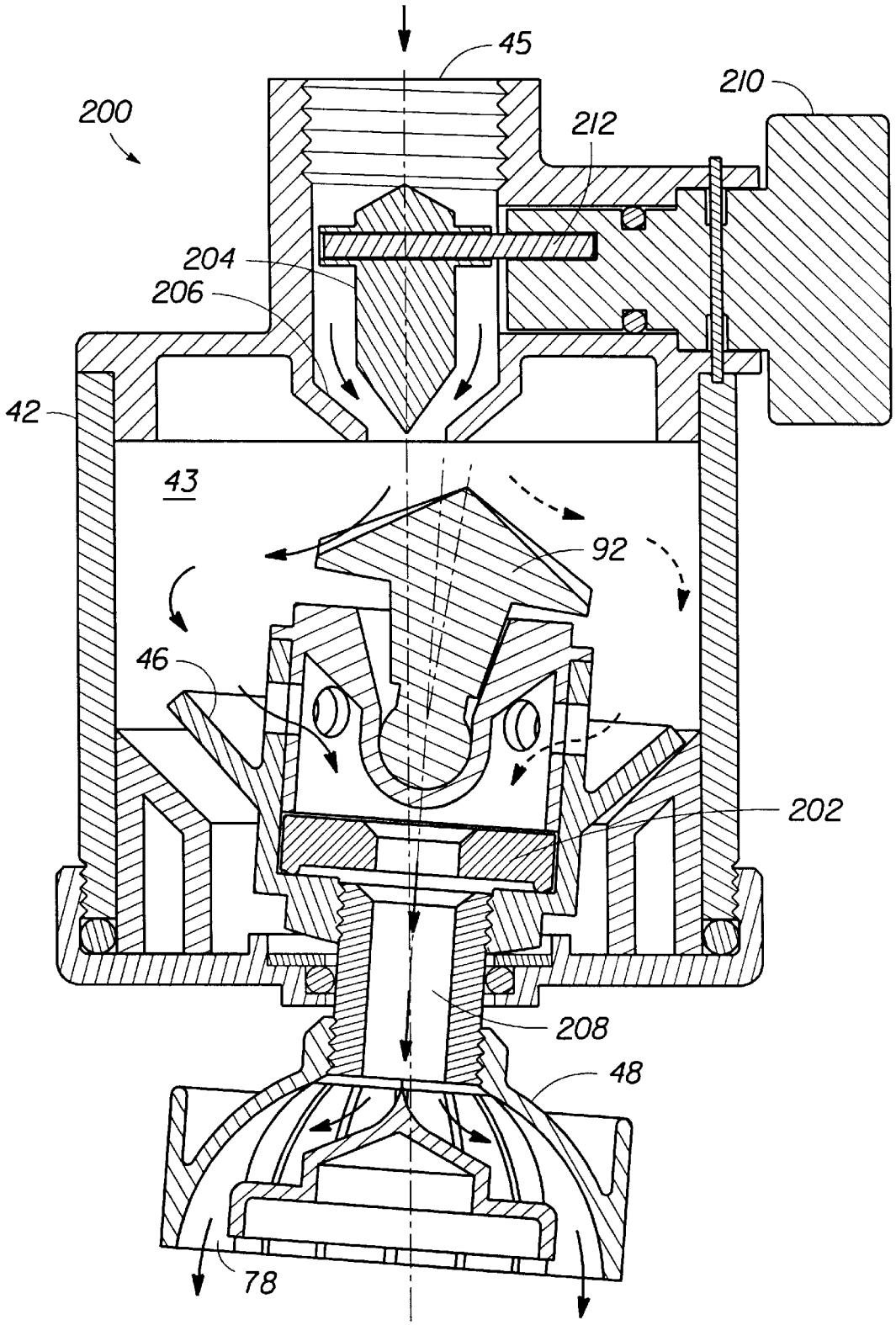
FIG. 21 is a cross-sectional side view of a spray head assembly having a flow washer velocity control system.

FIG. 21 is a cross-sectional side view of a spray head assembly 200 having a flow washer velocity control system. The term "flow washer velocity control system" as used herein refers to spray heads having a flow rate restricting washer 202 disposed downstream of the inlet valve 204 and motion inducing member 92 (i.e., the wobble turbine), but upstream of the nozzle outlet channels 78. The flow rate restricting washer 202 is designed to maintain a relatively constant fluid flow rate through its central orifice by constricting the orifice as the chamber pressure increases. Additional detail and design of flow rate restricting washers is described in U.S. Pat. Nos. 4,457,343 and 4,508,144, which are incorporated herein by reference.

By positioning the flow rate restricting washer 202 downstream of the motion inducing member 92, the flow rate of fluid being delivered through the nozzle 48 is maintained at a given level substantially independent of the fluid pressure or velocity within the chamber 43. A needle valve 204 is positioned in cooperation with a valve seat 206 in order to produce a flow restriction which causes a pressure drop in the chamber 43 and an increase in the velocity of the fluid imparting upon the motion inducing member 92. In this manner, the member 92 (turbine) can be made to move (wobble) at high rates regardless of the chamber pressure. Furthermore, at low fluid flow rates, the needle valve may be restricted (i.e., partially closed) in order to maintain a good movement or wobble speed. It should be noted that at higher chamber pressures, it is necessary to have a smaller effective inlet opening in order to cause sufficient fluid velocity for the member 92 to move at a high rate. For a residential shower, the preferred flow washer has a hole diameter of about 0.128 inches and may be used with an outlet tube 208 having a diameter greater than about 0.130 inches, most preferably about 0.140 inches.

In accordance with the present invention, a primary advantage of the flow washer velocity control system is that it can be used for impact control of the fluid exiting the nozzle. As discussed above, when the chamber pressure increases the flow washer orifice get smaller resulting in a higher velocity fluid stream passing therethrough. In conventional shower heads, the flow washer must be positioned at the inlet to the chamber and any benefit of a high velocity stream is dissipated in the chamber since the velocity of fluid exiting the nozzle is determined by the nozzle outlets. In the flow washer velocity control system of the present invention, the outlet channels in the spray housing do not restrict the flow of fluid, since the collective cross-sectional area of the channels is much greater than that of the flow washer or the velocity tube. Consequently, the high velocity fluid passing through the flow washer enters the spray housing, is redirected by the deflector, and exists the outlet channels at a high velocity without any significant restriction. The result is that a constant flow rate can be maintained while allowing the user to select a low impact or high impact spray.

With the needle valve 204 fully seated (closed), there is no flow through the nozzle. As the needle valve is slightly opened, such as by turning a handle 210 with a cam 212 attached to the needle valve 204, the fluid passes into the chamber 43 at a high velocity causing a high wobble rate and a low chamber pressure causing a gentle wobbling spray. As the needle valve 204 is opened further, the pressure in the chamber 43 increases causing the flow washer to constrict and provide a higher velocity and higher impact spray. Optionally, the motion inducing member may be slowed or stopped, by either further opening the valve 204 to produce a low velocity stream or opening a bypass around the motion inducing member, to produce an even higher impact stream. Both the gentle spray and the high impact spray provide fluid flow in accordance with the rating of the flow washer 202.

Figure 22:
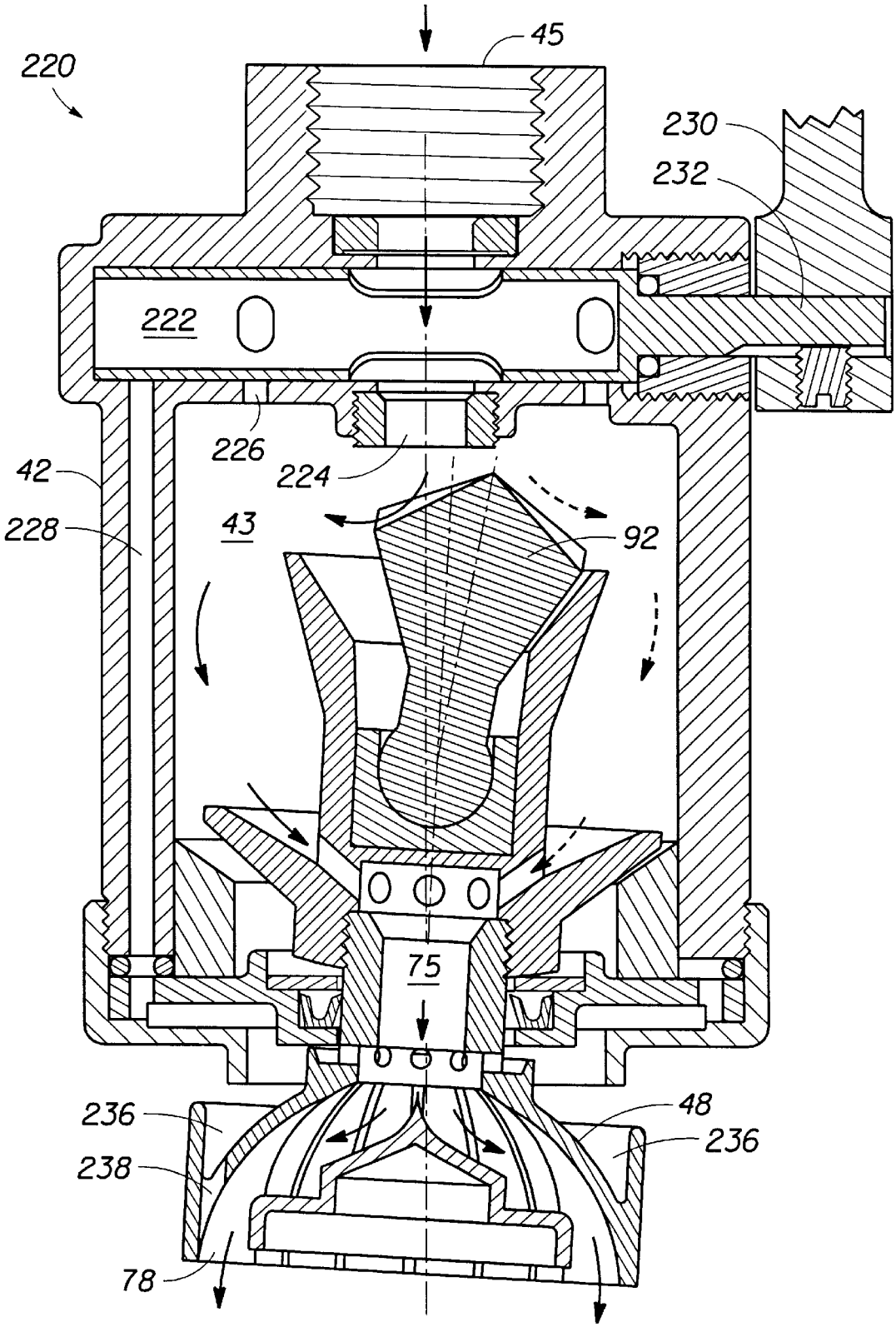
FIG. 22 is a cross-sectional side view of a spray head assembly having a bypass valve for redirecting fluid around the turbine or around the velocity tube.

FIG. 22 is a cross-sectional side view of a spray head assembly 220 having a bypass valve 222 for redirecting fluid around the turbine 92 or around the velocity tube 75. The bypass valve 222 selectively communicates between the fluid inlet 45 and two or more channels selected from the channel 224 directed at the turbine 92, the channel 226 directed into the chamber but around the turbine 92, or the channel 228 directed around the chamber 43 to the nozzle assembly 208. The bypass valve 222 is made to communicate fluid from the inlet 45 with one or more of the channels 224,226,228 by turning a handle 230 coupled to the stem 232. A preferred bypass valve element 222 may be described as a cylinder seated into the housing 42, wherein the cylinder walls have various holes at precise longitudinal and radial locations to align with appropriate channels 224,226,228 as the valve 222 is rotated. Detailed operation of the bypass valve 222 is described with relation to FIGS. 23A through 23F which follow.

Figure 23A:
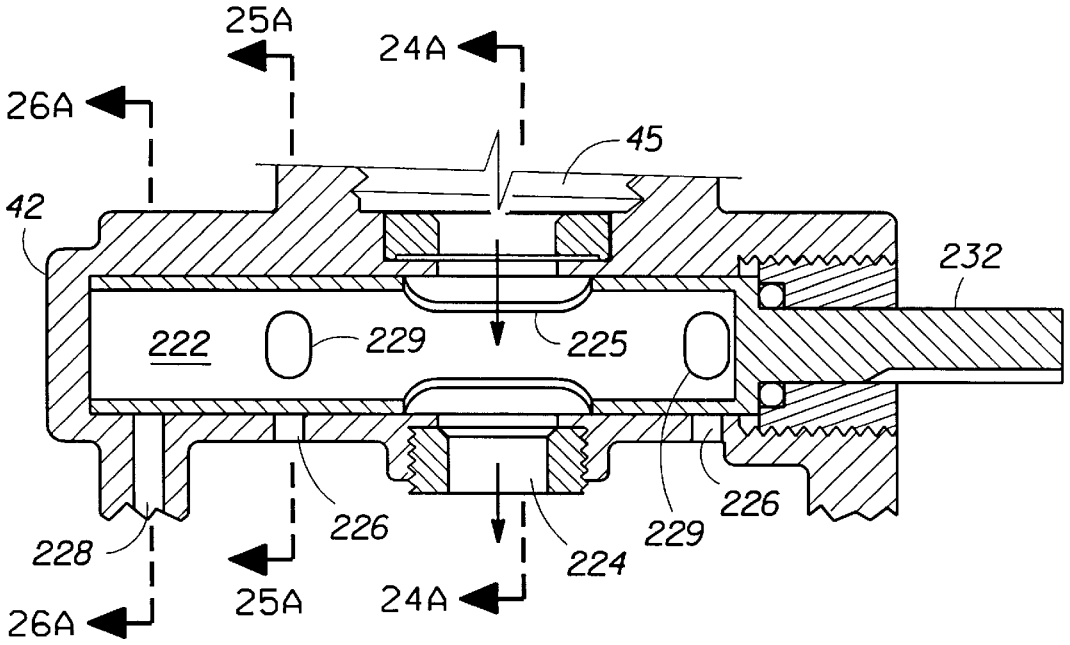
FIGS. 23A–F are cross-sectional side views of the bypass valve of FIG. 22 showing its operation at various angles of rotation.
Figure 23B:
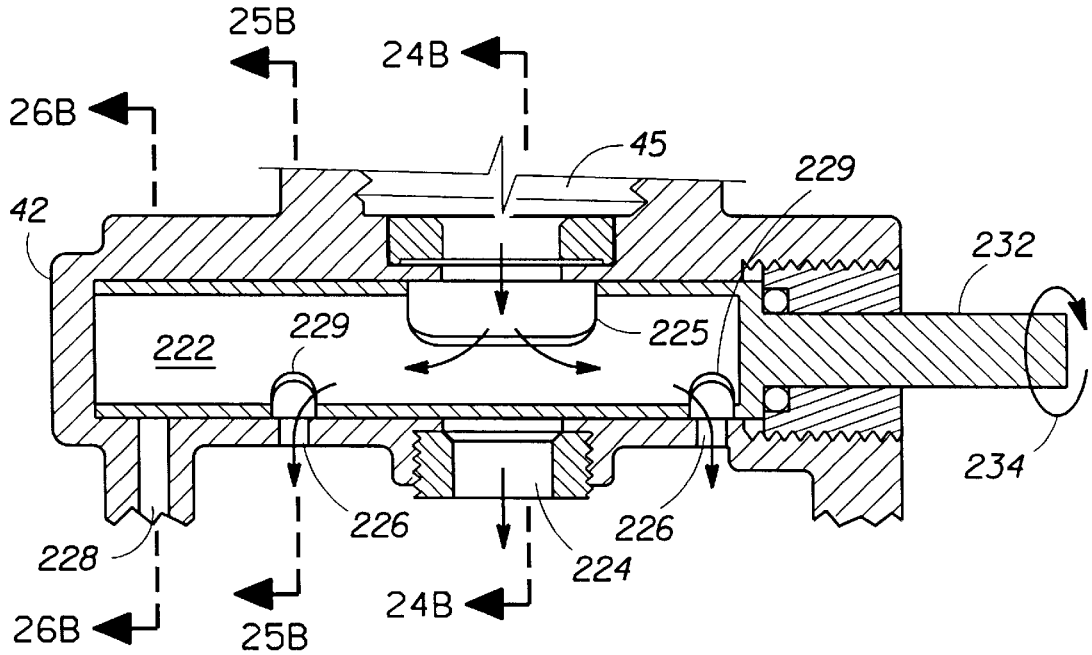
Figure 23C:
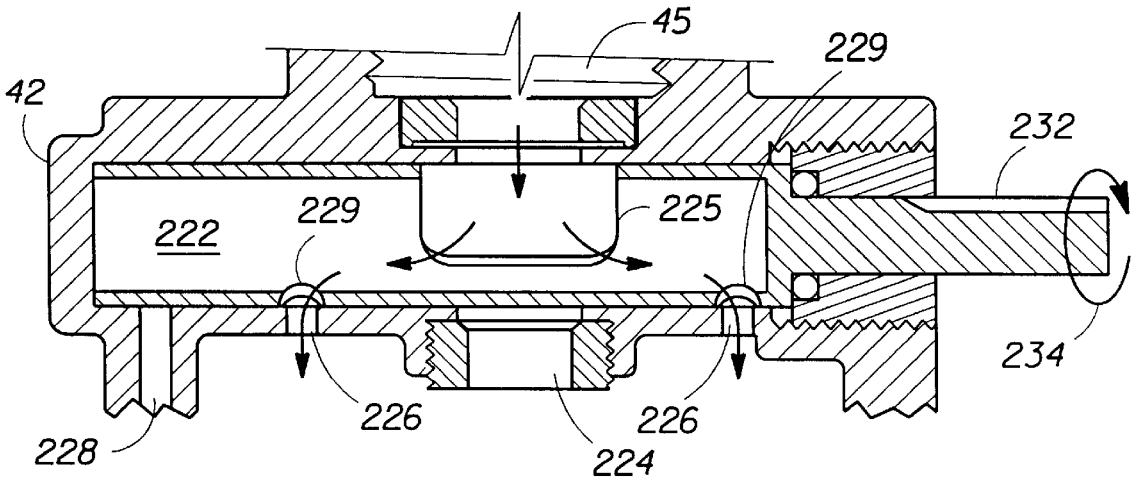

FIGS. 23A–F are cross-sectional side views of the bypass valve of FIG. 22 showing its operation at various angles of rotation. FIG. 23A shows the bypass valve in a position in which fluid is directed from inlet 45 to channel 224, substantially without restriction. Therefore, the nozzle assembly is in a wobbling mode. FIG. 23B shows the bypass valve in a position (45 degrees clockwise relative to FIG. 23A as shown by arrow 234) in which fluid is directed from inlet 45 through holes 225, 229 to both channels 224, 226, respectively. Therefore, the portion of fluid directed through one or more channels 226 bypasses the turbine, leaving a lower velocity stream through channel 224 and reducing the wobble speed of the turbine. FIG. 23C shows the bypass valve in a position (90 degrees clockwise relative to FIG. 23A as shown by arrow 234) in which fluid is directed from inlet 45 through holes 229 to the bypass channels 226, thereby eliminating the wobbling of the turbine while maintaining the flow rate through the nozzle assembly.

Figure 23D:
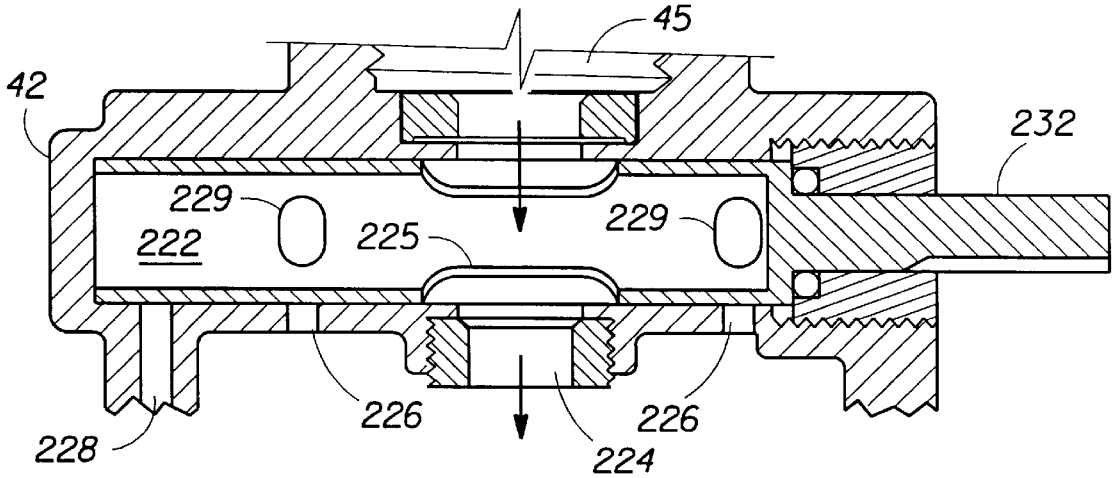
Figure 23E:
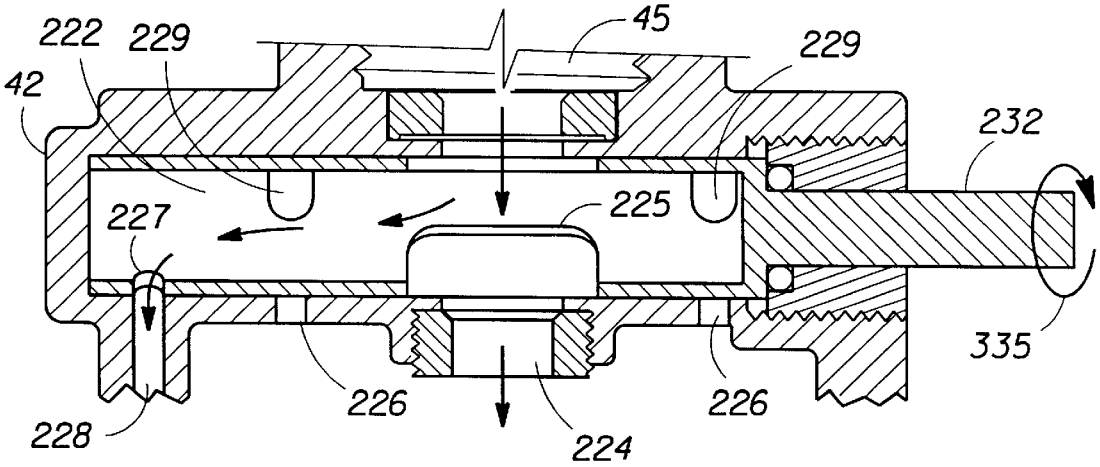
Figure 23F:
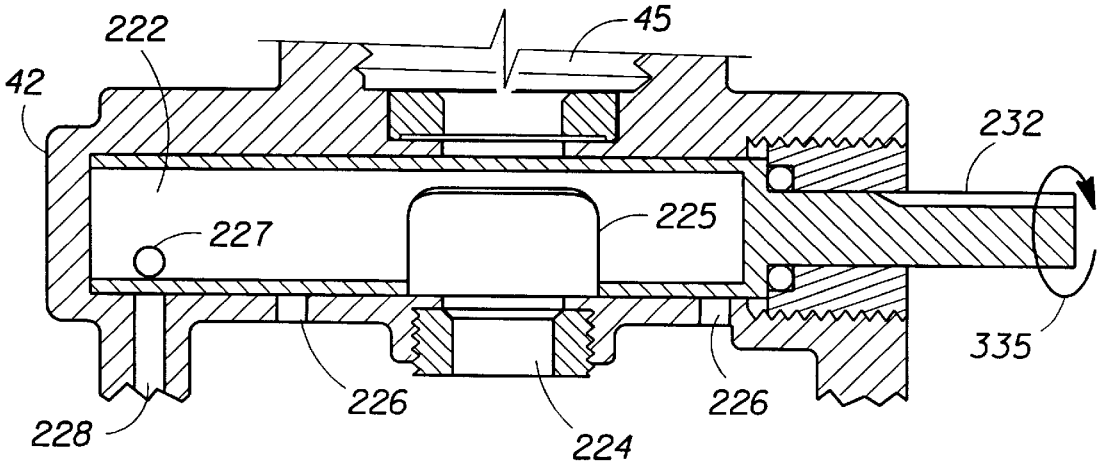
Figure 24A:
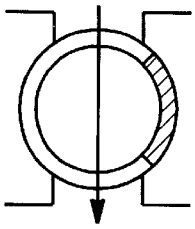
FIGS. 24A–E, 25A–E and 26A–E are partial cross-sectional views of the bypass valve in FIGS. 23A–E taken along lines 24—24, 25—25 and 26—26, respectively.
Figure 24B:
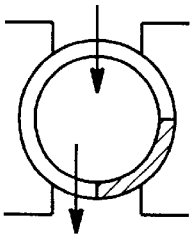
Figure 24C:
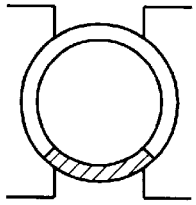
Figure 24D:
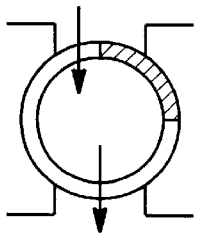
Figure 24E:
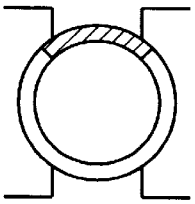
Figure 25A:
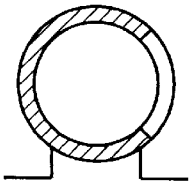
Figure 25B:
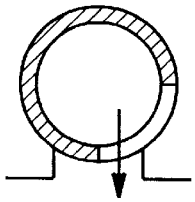
Figure 25C:
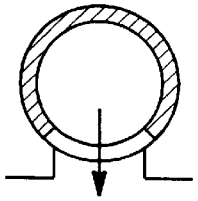
Figure 25D:
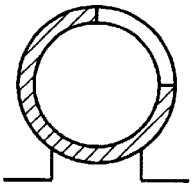
Figure 25E:
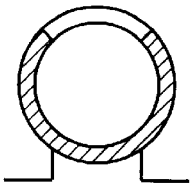
Figure 26A:
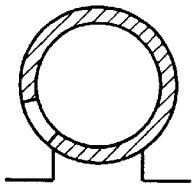
Figure 26B:
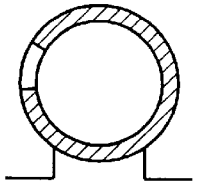
Figure 26C:
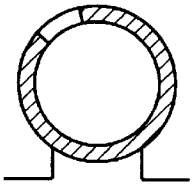
Figure 26D:
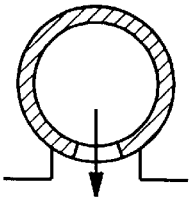
Figure 26E:
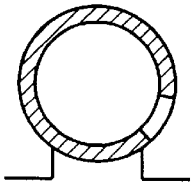

FIG. 23D is the same as FIG. 23A. FIG. 23E shows the bypass valve in a position (45 degrees counter-clockwise relative to FIG. 23D as shown by arrow 235) in which fluid is directed from inlet 45 through holes 225, 227 to both channels 224, 228, respectively. Therefore, the portion of fluid directed through one or more channels 228 (such as for a soft wash mode, use of a set of standard nozzles, or use of separate outlet channels in the spray nozzle) bypasses the turbine, leaving a lower velocity stream through channel 224 and reducing the wobble speed of the turbine. FIG. 23F shows the bypass valve in a position (90 degrees counter-clockwise relative to FIG. 23D as shown by arrow 235) in which the fluid inlet 45 is blocked and the spray nozzle is off. It should be recognized that the incremental rotation of the valve 222 may achieve more or less gradual transitions between modes of operation.

FIGS. 24A–E, 25A–E and 26A–E are partial schematic cross-sectional views of the bypass valve in FIGS. 23A–E taken along lines 24—24, 25—25 and 26—26, respectively.

Referring again to FIG. 22, the bypass channel 228 extends through the wall of the housing 42, then opens adjacent the nozzle assembly 48 such that fluid is directed into a collection trough 236. The trough 236 empties into the outlet channels 78 at low pressure and velocity through a plurality of holes 238 in order to reduce the overall velocity of the fluid exiting the outlet channels 78. The introduction of a low velocity stream into a main stream flowing at a higher velocity for the purpose of reducing the velocity of the main stream is referred to herein as a "soft wash" mode.

Figure 27:
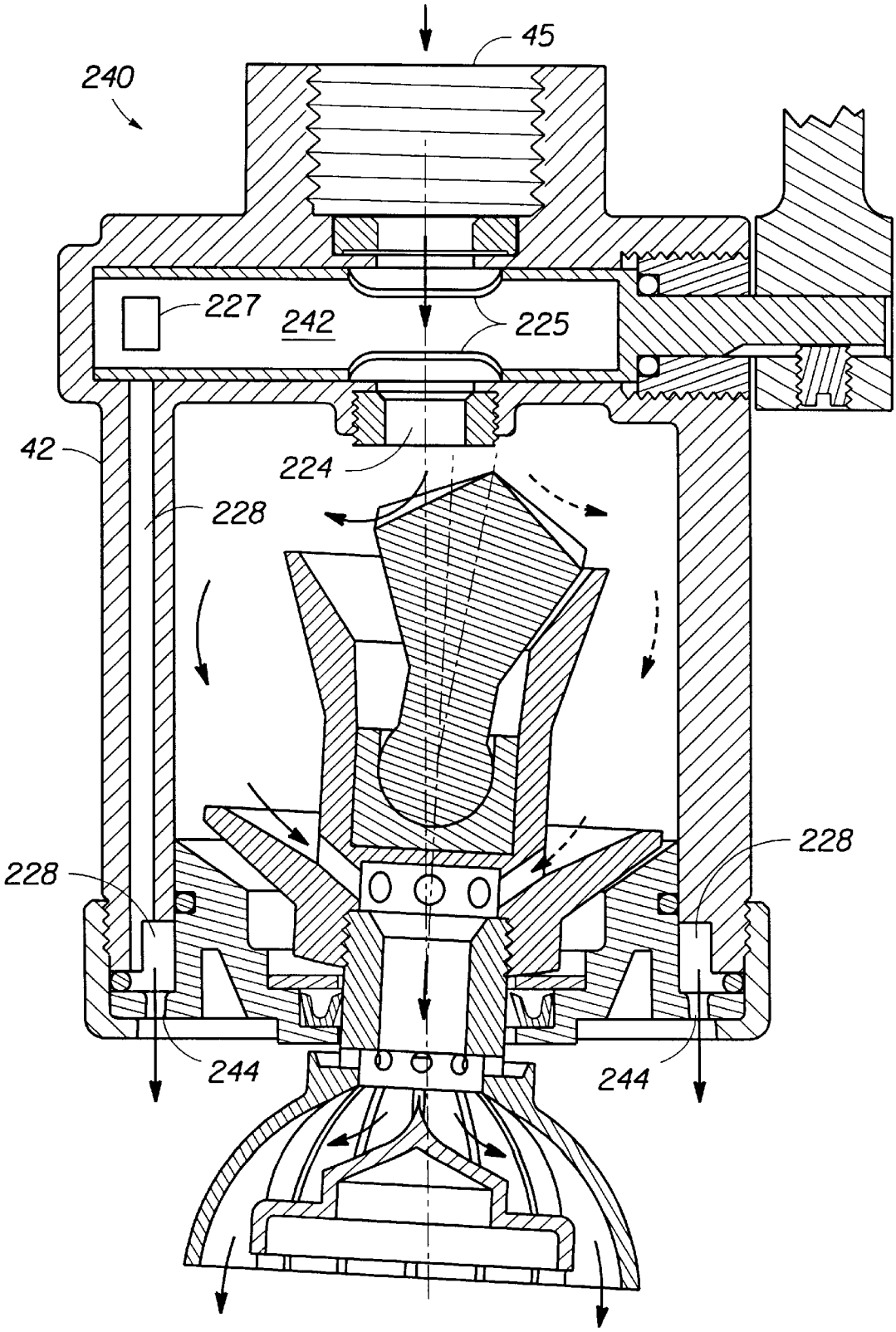
FIG. 27 is a cross-sectional side view of a spray head assembly having a bypass valve for controlling fluid to a set of stationary fluid outlet channels.

FIG. 27 is a cross-sectional side view of a spray head assembly 240 having a bypass valve 242 for controlling fluid to a set of stationary fluid outlet channels 244. While the bypass valve 242 operates in the same manner as bypass valve 222 of FIGS. 22–26, the valve 242 has been simplified by eliminating the channels 229. Clockwise rotation of the valve 242 directs fluid through the channel 228 and outlet channels 244. Channels 244 are preferably directed at such an angle as to increase the effective spray width of the spray head assembly 240.

Figure 28:
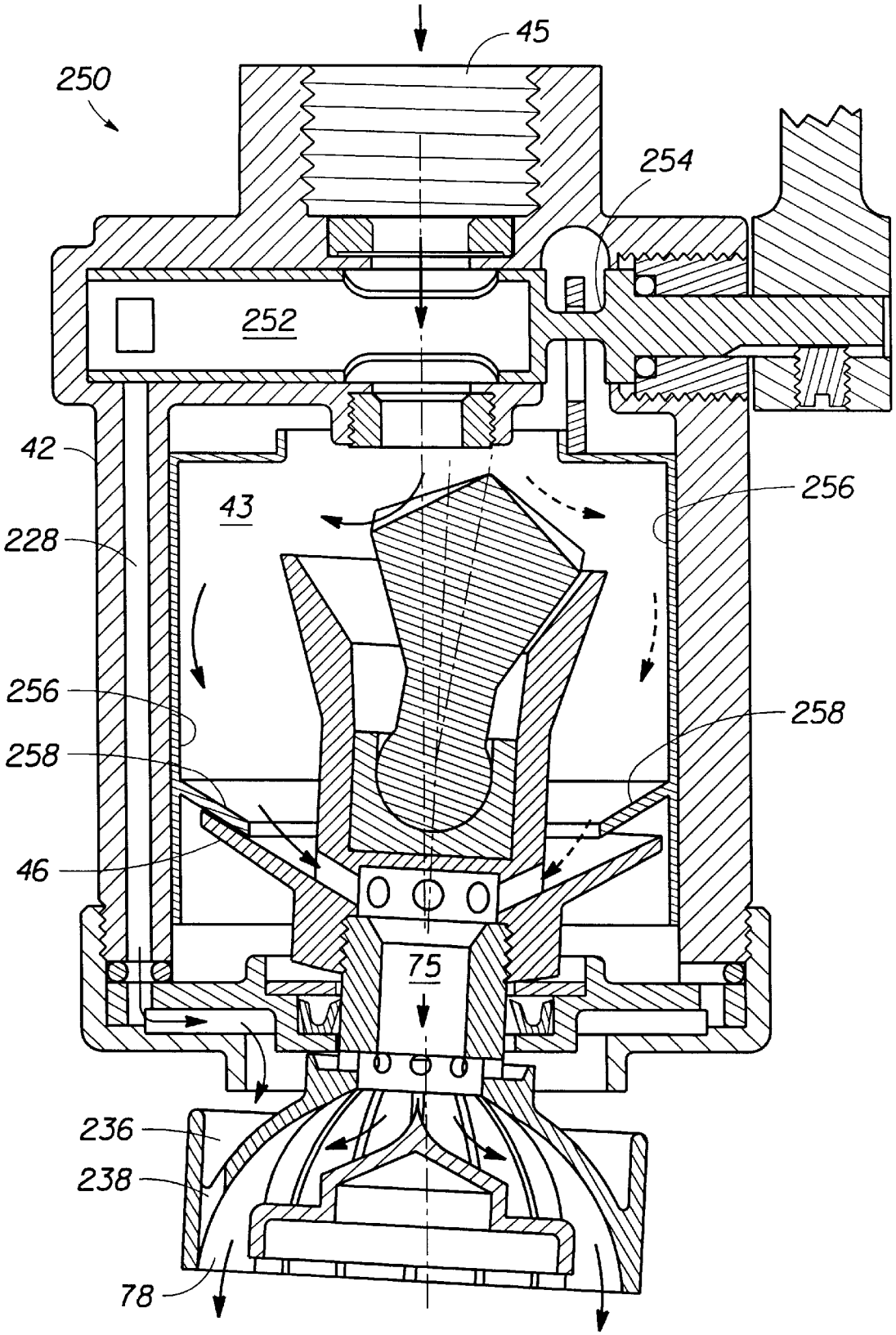
FIG. 28 is a cross-sectional side view of a spray head assembly having a bypass valve for redirecting fluid around the velocity tube and a cam shaft for moving a sleeve that controls the spray width.

FIG. 28 is a cross-sectional side view of a spray head assembly 250 having a bypass valve 252 for redirecting fluid around the velocity tube 75 through channel 228 to the trough 236. The bypass valve 252 also includes a cam shaft 254 (off-center of the bypass valve in the direction out of the page) engaging a sleeve 256 that controls the spray width of the nozzle assembly by restricting movement of the wobble plate 46. As the bypass valve 252 is rotated, the cam shaft 254 lowers the sleeve 256 so that the annular ledge 258 comes into contact with the wobble plate 46 limiting the degree of wobble and, consequently, narrowing the spray width. Further lowering of the sleeve may freeze the wobble plate and provide a high impact fluid flow.

Figure 29:
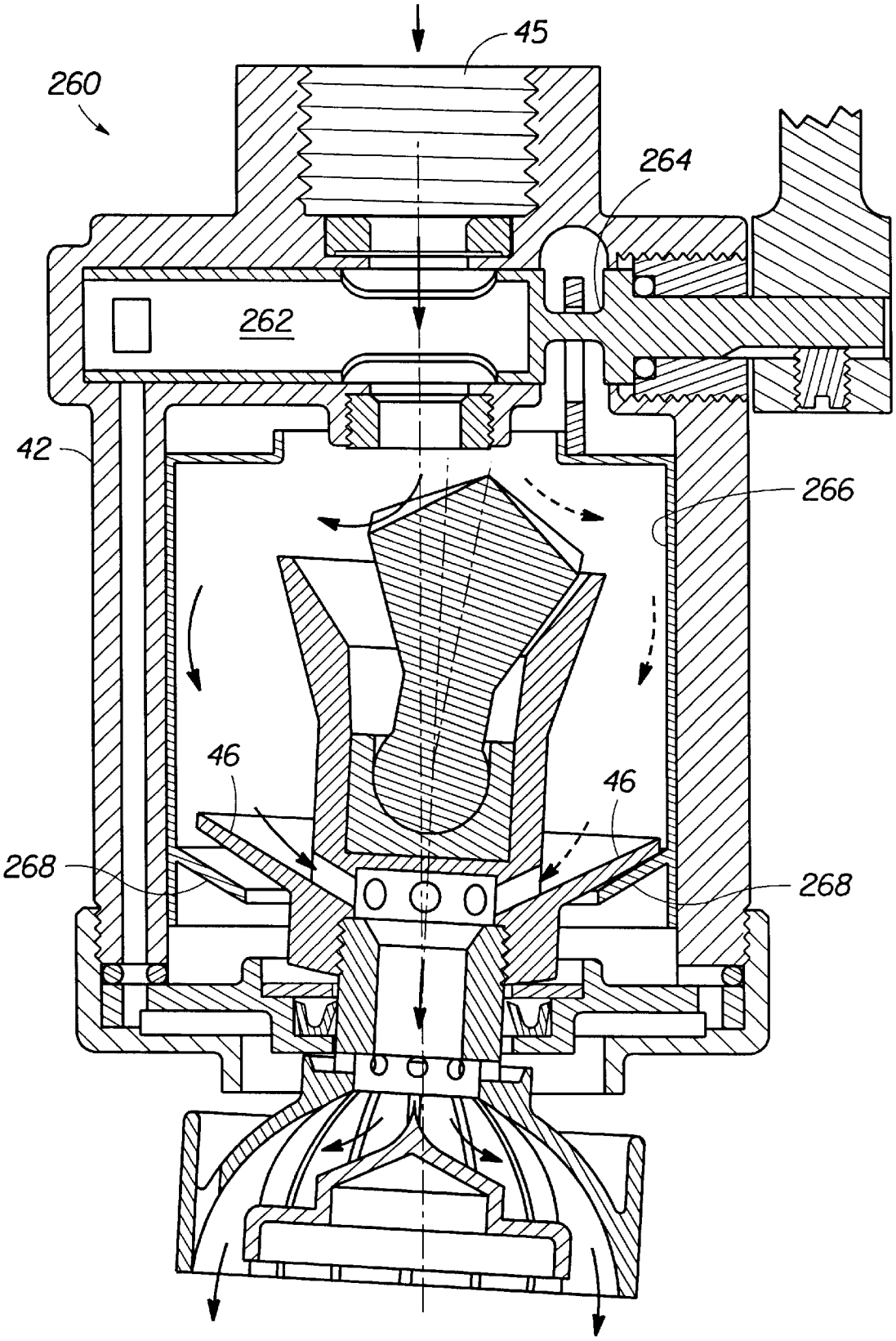
FIG. 29 is a cross-sectional side view of a spray head assembly as in FIG. 26, except that the sleeve is disposed below the wobble plate.

FIG. 29 is a cross-sectional side view of a spray head assembly as in FIG. 28, except that the sleeve 266 has a ledge 268 disposed below the wobble plate 46. As the bypass valve 262 rotated, the cam 264 is made to raise the sleeve 266 so that the ledge 268 comes into contact with the wobble plate 46, thereby limiting the nozzle assembly's range of movement and narrowing the spray width.

Figure 30:
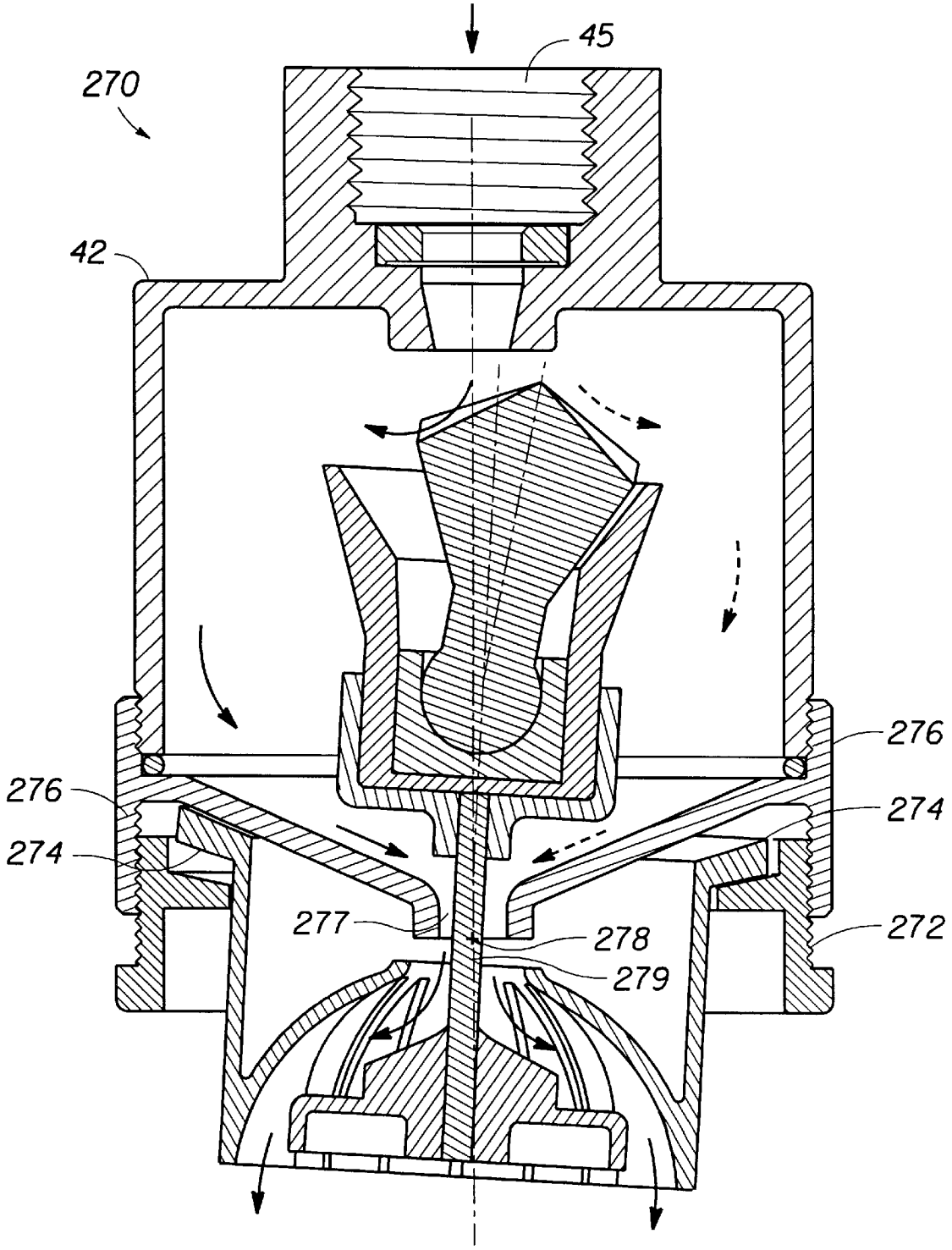
FIG. 30 is a cross-sectional side view of a spray head assembly having a spray width adjustment ring below the wobble plate.

FIG. 30 is a cross-sectional side view of a spray head assembly 270 having a spray width adjustment ring 272 below the wobble plate 274. As the adjustment ring 272 is turned clockwise, the adjustment ring 272 is drawn towards the ring 276 via threaded engagement and the range of movement of the wobble plate 274 is limited. All surfaces of the spray head assembly 270 contacted by the wobble plate 274 are preferably angled towards a common point 278 in order to keep the post 279 centered within the channel 277.

Figure 31:
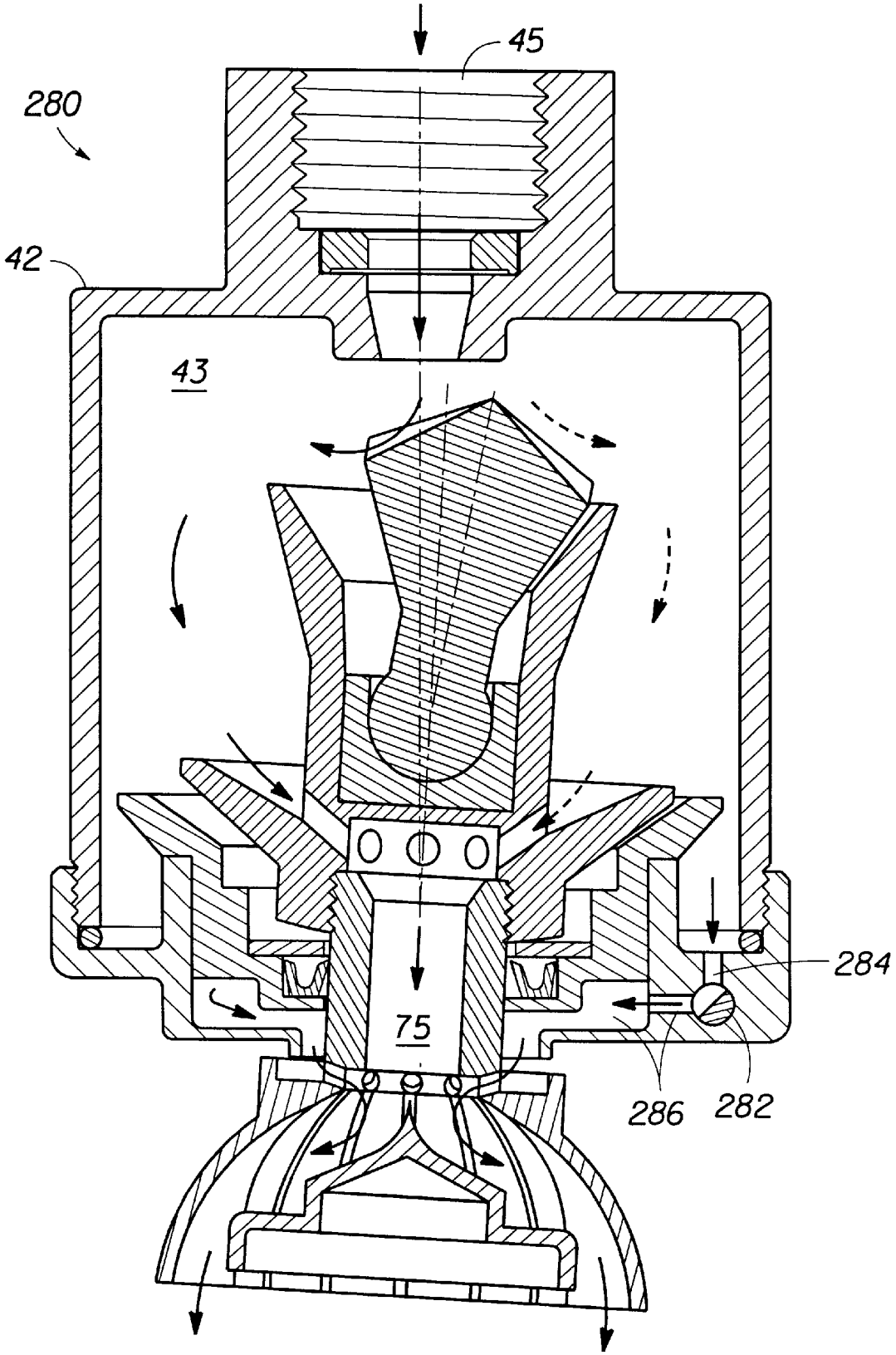
FIG. 31 is a cross-sectional side view of a spray head assembly having a bypass valve for directing water around the velocity tube to achieve a soft wash.

FIG. 31 is a cross-sectional side view of a spray head assembly 280 having a bypass valve 282 (of any known type) for directing water from the chamber 43 around the velocity tube 75 to the nozzle assembly for achieving a soft wash.

Figure 32:
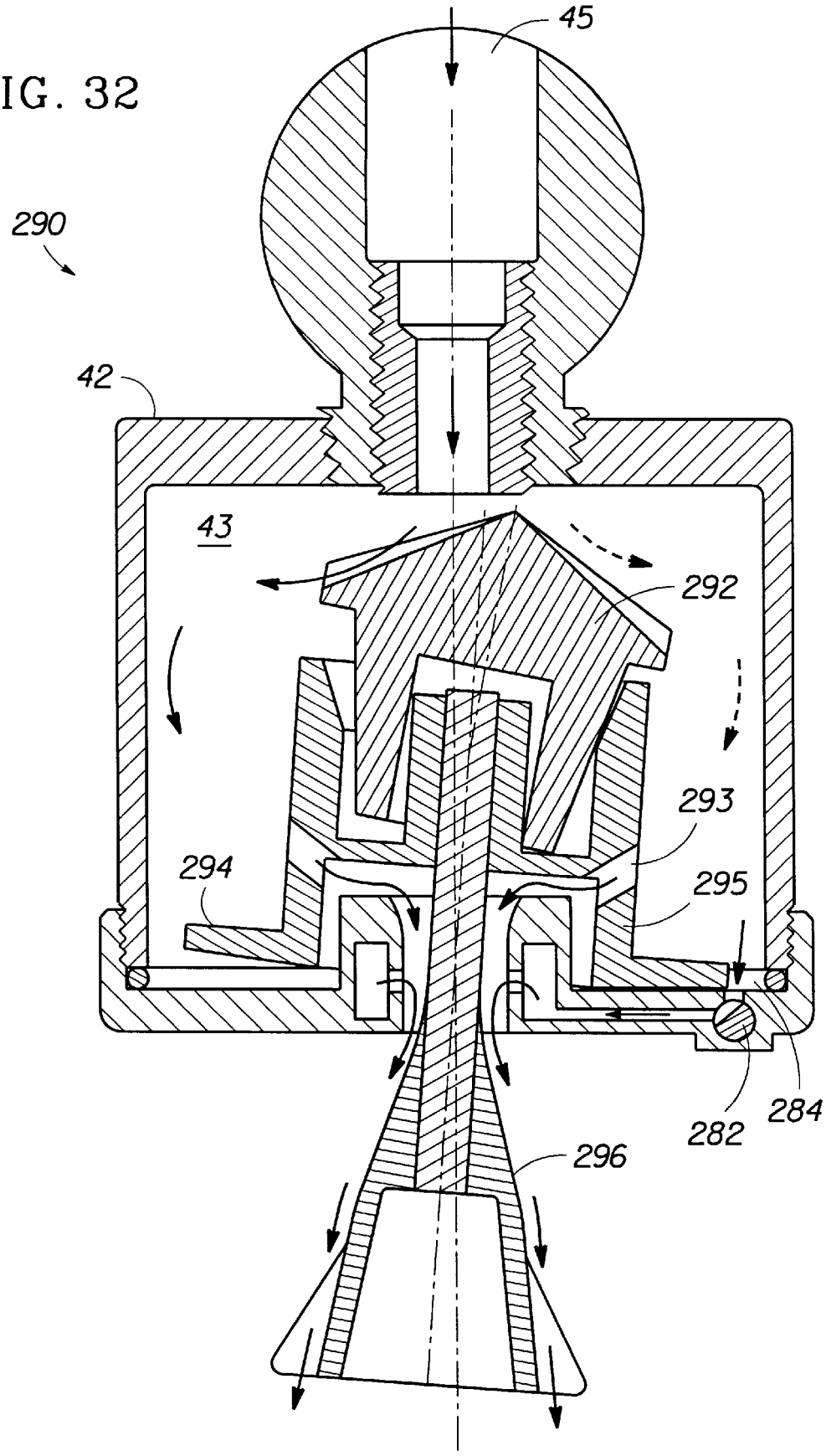
FIG. 32 is a cross-sectional side view of a spray head assembly having external fluid delivery to an external nozzle assembly.

FIG. 32 is a cross-sectional side view of a spray head assembly 290 having a wobble inducing member 292, a wobble limiting member 294 and a nozzle 296. Fluid is delivered from the chamber 43 through holes 293 and channel 295 to an external surface of the nozzle 296. Additionally, a bypass valve 282 is included to provide a low velocity softwash stream to the channel 295.

Figure 33:
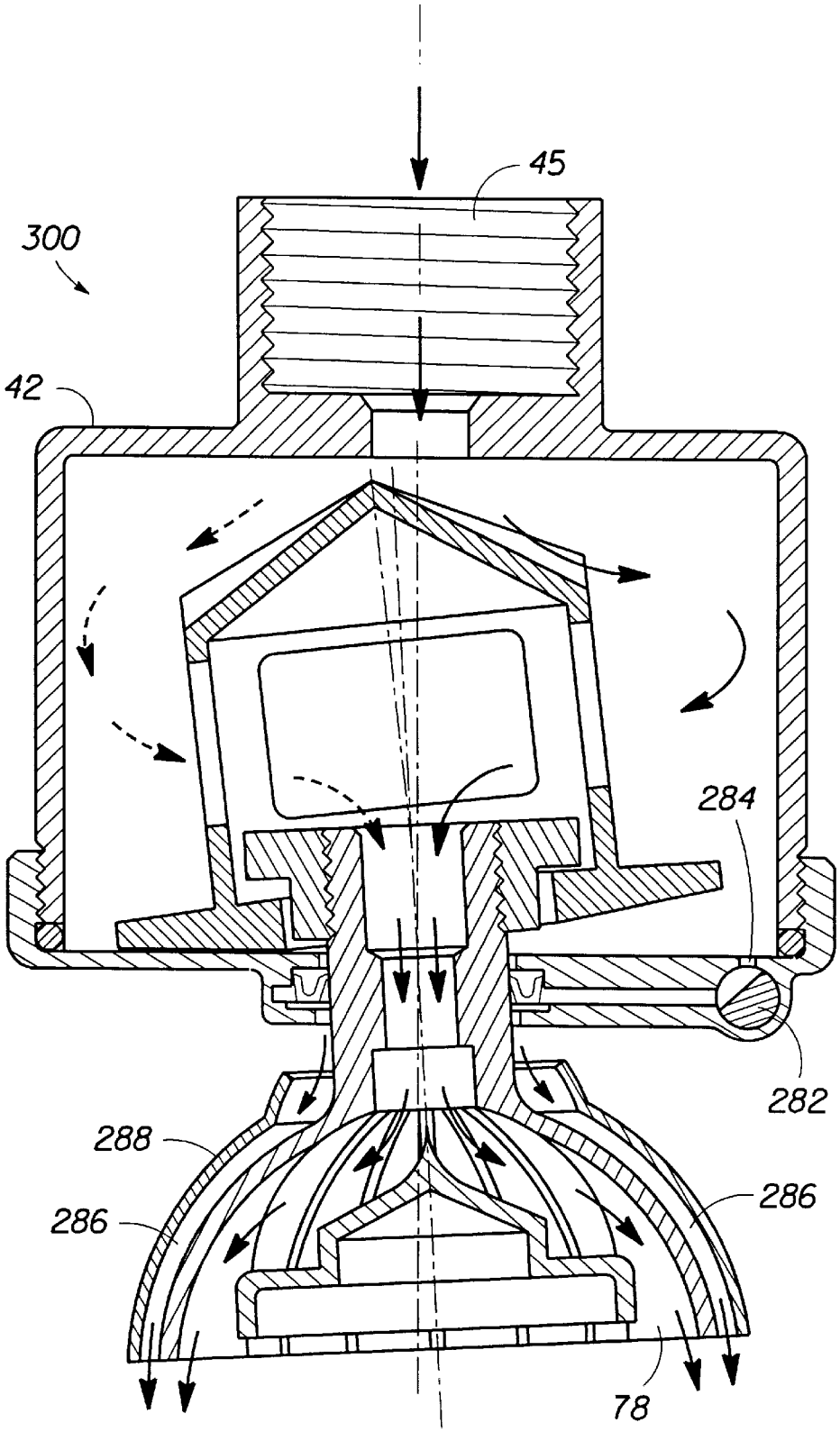
FIG. 33 is a cross-sectional side view of a spray head assembly having a lifting ring.

FIG. 33 is a cross-sectional side view of a spray head assembly 300 that is substantially similar to the spray head assembly of FIG. 19 except for the addition of a softwash bypass valve 282 delivering fluid into communication with the spray nozzle outlet channels 286. The outlet channels 286 are preferably directed so that the fluid exiting the channels 286 will mix with the fluid exiting outlet channels 78, but only after the two fluid streams have exited the nozzle 288.

Figure 34:
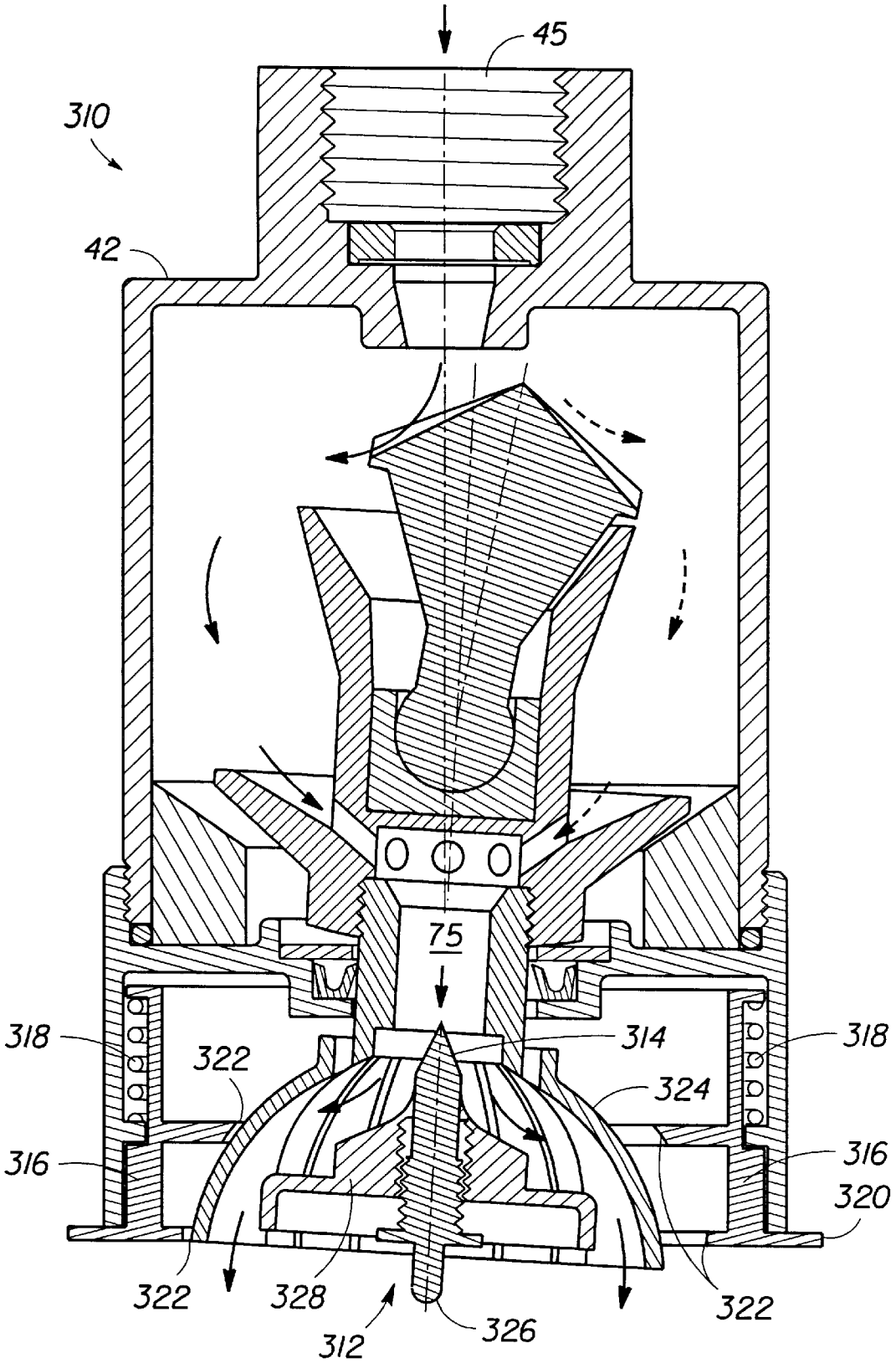
FIG. 34 is a cross-sectional side view of a spray head assembly having an impact adjustment component disposed downstream of the velocity tube.

FIG. 34 is a cross-sectional side view of a spray head assembly 310 having an impact (velocity) adjustment assembly disposed downstream of the velocity tube 75. The impact adjustment assembly 312 includes a needle valve 314 that may be positioned into the velocity tube 75 or other orifice to provide a greater flow restriction and an increase in the velocity of fluid passing there through. As shown in FIG. 34, the assembly 310 may be provided with a convenient gripping member 316 for stopping the wobble of the nozzle assembly while the needle valve 314 position is adjusted. The gripping member 316 is shown as an annular ring that is urged upward by a compressed spring 318. A handle 320 is provided to allow the user to pull the gripping member 316 downward until the gripping surfaces 322 contact the outer surface of the spray housing 324 and secure the nozzle assembly in a stationary position. The tab 326 on the end of the needle valve 314 may then be held between the users fingers and turned. Because the needle valve 314 is threaded through the center of the deflector 328, the valve 314 can be advanced and retracted to obtain a desired degree of fluid impact. It is preferred that the threads be made sufficiently tight to secure the needle valve position despite prolonged wobbling or vibration of the nozzle assembly.

While the foregoing is directed to the preferred embodiment of the present invention, other and further embodiments of the invention may be devised without departing from the basic scope thereof, and the scope thereof is determined by the claims which follow.

What is claimed is:

1. A spray head assembly comprising:

a housing having a nozzle assembly;

means for wobbling the nozzle assembly; and means for adjusting the range that the nozzle assembly can wobble.

2. The spray head assembly of claim 1, wherein the means for wobbling is a wobble turbine.

3. The spray head assembly of claim 1, wherein the nozzle assembly includes a wobble plate, and the means for adjusting the range that the nozzle assembly can wobble comprises a sleeve adjacent the wobble plate and a cam coupled to the sleeve.

4. The assembly of claim 1, wherein the means for adjusting the range that the nozzle assembly can wobble comprises a sleeve adjacent the nozzle assembly and a means for raising and lowering the sleeve to restrict movement of the nozzle assembly.

5. The assembly of claim 4, wherein the means for raising and lowering the sleeve is a cam coupled to the sleeve.

6. The assembly of claim 5, wherein the cam moves the sleeve downward to restrict movement of the nozzle assembly.

7. The assembly of claim 5, wherein the cam moves the sleeve upward to restrict movement of the nozzle assembly.

8. The assembly of claim 5, wherein the nozzle assembly includes a wobble plate, and wherein the sleeve restricts movement of the wobble plate.

9. A spray head assembly comprising:

a housing having a nozzle assembly;

means for wobbling the nozzle assembly; and means for adjusting the velocity of fluid directed at the means for wobbling.

10. The spray head assembly of claim 9, wherein the means for adjusting the velocity is a flow control valve.

11. The spray head assembly of claim 9, wherein the means for adjusting the velocity is a bypass valve.

12. A spray head assembly comprising, a housing comprising a first end having a fluid inlet and a second end forming a collar;

a nozzle assembly comprising a first end disposed inside the housing, a middle portion extending through the collar, a second end having a fluid outlet, a fluid conduit providing fluid communication between the housing and the fluid outlet, and a wobble limiting member, wherein the nozzle assembly is positioned downstream of the fluid inlet;

a wobble inducing member facing the fluid inlet and engaging the first end of the nozzle assembly; and a bypass valve having a first outlet providing selective communication from the fluid inlet towards the wobble inducing member and a second outlet providing selective communication from the fluid inlet around the wobble inducing member.

13. The spray head assembly of claim 12, further comprising a fluid channel having a first end in fluid communication with the second outlet of the bypass valve and a second end in fluid communication with the second end of the nozzle assembly.

14. The spray head assembly of claim 13, wherein the middle portion of the nozzle assembly includes a velocity tube.

15. The spray head assembly of claim 12, further comprising a third fluid outlet providing selective communication from the fluid inlet to a fluid channel, the fluid channel having a first end in fluid communication with the third fluid outlet and a second end in fluid communication with the second end of the nozzle assembly.

16. A spray head assembly comprising:

a housing having a fluid inlet, a nozzle assembly, an opening in said housing with said nozzle assembly extending through said opening and having an exterior portion providing an outlet nozzle and an interior portion positioned within said housing, said nozzle assembly having a fluid channel connecting the interior portion within the housing and the outlet nozzle outside of the housing, means within said housing for inducing wobble of the nozzle assembly, a fluid conduit within said housing connected to the fluid inlet and having outlet means exteriorly of said outlet nozzle, and a bypass valve controlling flow from said inlet to said fluid conduit and to said nozzle assembly.

17. The spray head assembly of claim 16 wherein said bypass valve is within said housing.

18. The spray head assembly of claim 16 wherein said fluid conduit outlet means directs water toward the exterior of said outlet nozzle.

* * * * *